US007367749B2

(12) United States Patent
Kim

(10) Patent No.: US 7,367,749 B2
(45) Date of Patent: May 6, 2008

(54) BACKPACK

(75) Inventor: Jong-Kee Kim, Yongin-si (KR)

(73) Assignee: Sancheong Co. Ltd. (KR)

( * ) Notice: Subject to any disclaimer, the term of this patent is extended or adjusted under 35 U.S.C. 154(b) by 147 days.

(21) Appl. No.: 10/579,861

(22) PCT Filed: Jun. 22, 2004

(86) PCT No.: PCT/KR2004/001494

§ 371 (c)(1),
(2), (4) Date: May 17, 2006

(87) PCT Pub. No.: WO2005/048769

PCT Pub. Date: Jun. 2, 2005

(65) Prior Publication Data

US 2007/0090137 A1 Apr. 26, 2007

(30) Foreign Application Priority Data

Nov. 19, 2003 (KR) ..... 10-2003-0082372
Mar. 15, 2004 (KR) ..... 10-2004-0017283
May 11, 2004 (KR) ..... 10-2004-0032917

(51) Int. Cl.
*B63C 11/02* (2006.01)

(52) U.S. Cl. ..... 405/186

(58) Field of Classification Search ..... 405/184, 405/186

See application file for complete search history.

(56) References Cited

U.S. PATENT DOCUMENTS 5,249,890 A * 10/1993 Bergstrom ..... 405/186
5,346,419 A * 9/1994 Kaiser ..... 441/96

FOREIGN PATENT DOCUMENTS

DE 29704328 U1 * 5/1997
GB 2247653 A * 3/1992
JP 3046702 U * 12/1997
WO WO 9730609 A1 * 8/1997

* cited by examiner

*Primary Examiner*—Tara L. Mayo
(74) *Attorney, Agent, or Firm*—Daniel P. Burke & Associates, PLLC

(57) ABSTRACT

A backpack for back-mounting a compressed-air cylinder, fastened to the backpack by a cylinder fastening belt, when a user wears harnesses and a waist belt. The backpack inlcudes a backboard (100) having support hooks (105) to support the compressed-air cylinder (50); a harness support (130) for the harnesses (30) coupled to the backboard (100) so as to rotate upwards and downwards around the center; a waist protector (120) coupled to the backboard (100) in the back of the harness support (130) so as to cover and protect the back of the user's waist; and a rotary unit for rotatably supporting both the harness support (130) and the waist protector (120) on the backboard (100). The waist protector and the harness support move separately from the backboard by the rotary unit, thus allowing the user to work without stressed by the waist belt or the harnesses.

17 Claims, 18 Drawing Sheets

BACKPACK

TECHNICAL FIELD

The present invention relates, in general, to a backpack used for back-mounting something and, more particularly, to a backpack used for conveniently back-mounting a compressed-air cylinder.

BACKGROUND ART

Generally, backpacks used for back-mounting compressed-air cylinders include a flat backboard, with shoulder harnesses, a waist belt and a cylinder fastening belt integrated with the backboard into a single structure. To back-mount a compressed-air cylinder using such a backpack, the compressed-air cylinder is fastened to the backboard using the cylinder fastening belt, and thereafter, a user back-mounts the compressed-air cylinder by wearing both the shoulder harnesses on his/her shoulders and the waist belt around his/her waist.

As shown in FIG. 1, a conventional backpack comprises a backboard 10 to which a compressed-air cylinder 50 is fastened in a vertical position, with shoulder harnesses 30 and a waist belt 20 having a buckle 24 all being coupled to the backboard 10.

Harness locking holes 11 are formed on an upper portion of the backboard 10. The upper end of each harness 30 passes through each harness locking hole 11 and is sewn along a line S, thus being coupled to the locking hole 11. A cylinder fastening belt 40 is coupled to a middle portion of the backboard 10 to fasten the compressed-air cylinder 50 to the backboard 10. A back belt 21 having clips 22 at both ends thereof is coupled to a lower portion of the backboard 10, and is worn around the back of the waist of a user, with the waist belt 20 coupled to the clips 22.

In the backpack, the back belt 21 is inserted into back belt passing holes 11*a* formed on both sides of the backboard 10, of which the intermediate portion is placed on the backboard 10 as shown by the dotted line in the drawing. The lower end of each harness 30 is sewn along another sewn line S to be attached to each of the outside parts of the back belt 21 having the clips 22.

Because the lower ends of the harnesses 30 are sewn to the outside parts of the back belt 21 along the horizontal sewn lines S, respectively, the lower ends of the harnesses 30 are placed parallel to the lengthwise axis of the back belt 21.

The lower ends of the harnesses 30 are sewn to the back belt 21 along the sewn lines S as described above. Thus, the harnesses 30 are integrated with the back belt 21 and, furthermore, the backboard 10 is integrated with both the harnesses 30 and the back belt 21 into a single structure.

A pair of support hooks 12 is provided on the center of a lower portion of the backboard 10 and supports the neck part of the air cylinder 50 having a regulator 56. An L-shaped metal support frame 15, which is produced separately from the backboard 10, is mounted to the lower end of the backboard 10 through a bolting process. Due to the support frame 15, a user may support the backboard 10 on a support surface while wearing the harnesses 30.

Flashing lamps 13 to indicate a user,s, location are provided on the backboard 10 at opposite sides of the pair of support hooks 12. A battery casing 14 to hold therein batteries to supply electricity to the flashing lamps 13 is provided on the lower portion of a back surface of the backboard 10 at a position near the flashing lamps 13.

In the drawing, the reference numeral 55 denotes an air hose that is connected to the regulator 56 of the compressed-air cylinder 50.

To back-mount the compressed-air cylinder 50 using the above-mentioned backpack, the compressed-air cylinder 50 is placed on the backboard 10 in an upside-down position, with the neck of the cylinder 50 supported by the support hooks 12. The cylinder 50 is, thereafter, fastened to the backboard 10 by the cylinder fastening belt 40.

After setting the backboard 10 on the support frame 15, the user back-mounts the compressed-air cylinder 50 by wearing the harnesses 30 and the waist belt 20.

However, when the user with the conventional backpack on his/her back bends his/her upper body to the left or right, the back belt 21, the waist belt 20, the harnesses 30 and the backboard 10 which are integrated into a single structure move along with the bending motion of the user's body. Thus, the compressed-air cylinder 50 leans in the same direction and at the same angle as the upper body of the user.

Due to the leaning of the compressed-air cylinder 50, the center of gravity of the cylinder 50 is shifted to cause the user to easily fall in the direction that the air cylinder 50 is leaning.

Particularly, when the user of the backpack is a fireman and falls due to the change in the center of gravity of the compressed-air cylinder 50 on the scene of a fire, the user may meet with misfortune.

Furthermore, in the conventional backpack, the harnesses 30 are coupled to the back belt 21 to form an integrated structure. Thus, when the user with the backpack raises his/her arm, the back belt 21 tensions the harnesses 30. Consequently, the harnesses 30 press the shoulders of the user. Thus, the user with the backpack is inconvenienced while using his/her arms due to the restriction caused by both the back belt 21 and the harnesses 30.

In addition, because the battery casing 14 is provided on the back surface of the backboard 10, the user must remove the backpack when needing to exchange the batteries for new ones. Thus, it is inconvenient to ex change the batteries for new ones and excessive time must be consumed while changing the batteries.

Furthermore, the support frame 15 to support the backboard 10 is shaped as an angled structure that may easily catch on protruding objects, such as steel reinforcing bars, while the user with the backpack on his/her back moves around a place. Also, the support frame 15 is made of iron, resulting in an increase in the weight of the backpack.

When the support frame 15 of the backpack catches on a protruding object while the fireman is putting out a fire, the fireman must release the support frame 15 from the protruding object, delaying the extinguishing work. Furthermore, due to the support frame 15 which may easily catch on protruding objects, the fireman may have difficulty quickly escaping from danger at the scene of a fire.

Furthermore, because the support frame 15 is produced separately from the backboard 10, the support frame 15 must be attached to the backboard 10 through an additional process that increases the time required to produce the backpack.

The consumption of excessive time during backpack production process results in a reduced quantity of backpacks being produced.

DISCLOSURE OF THE INVENTION

Technical Problem

Accordingly, the present invention has been made keeping in mind the above problems occurring in the prior art, and an object of the present invention is to provide a backpack in which both a waist belt and harnesses move independently from a backboard, the harnesses move independently from the waist belt, and inclination angles (movable angles in upward, downward, forward and backward directions) of both the waist belt and the harnesses worn on a user can be freely adjusted as desired.

Another object of the present invention is to provide a backpack in which the location of a battery casing is changed from a conventional location, thus allowing for easy changing of batteries, and which is produced without a conventional process of attaching a support frame to the backboard, and in which the structure of the support frame is changed to prevent the support frame from catching on protruding objects.

Technical Solution

In order to accomplish the above objects, the present invention provides a backpack, comprising: a backboard which holds, on an upper portion thereof, one ends of the harnesses and holds, at both sides of a middle portion thereof, the cylinder fastening belt, and comprises a pair of support hooks that protrude from a lower portion of the backboard while being spaced apart from each other to support thereon the compressed-air cylinder; a harness support which holds, at opposite arms thereof, the other ends of the harnesses and is coupled to a lower portion of a back surface of the backboard so as to rotate upwards and downwards around a center thereof, with the opposite arms of the harness support longitudinally extending horizontally in opposite directions; a waist protector having a plate shape coupled to the backboard at a position in the back of the harness support so that both ends of the waist protector rotate upwards and downwards around a center of the waist protector, with ends of the waist belt coupled to the ends of the waist protector, the waist protector thus covering and protecting the back of the user's waist; and a rotary unit for rotatably supporting both the harness support and the waist protector on the backboard.

The rotary unit may comprise: a hinge shaft protruding from the center of the waist protector and sequentially passing through the center of the harness support and a center of the lower-portion of the backboard, thus serving as a rotating shaft for both the waist protector and the harness support; a hinge shaft cover mounted to the hinge shaft at a position in front of the backboard, so as to rotatably couple the hinge shaft to the backboard; and a locking member which locks the hinge shaft cover to the hinge shaft.

Thus, the waist belt and the harnesses of the backpack are operated around the hinge shaft separately from the backboard, and furthermore, the waist belt and the harnesses are operated separately, so that the user works freely without being restricted or stressed by the waist belt or the harnesses.

The rotary unit may further comprise: a rotation guide means for guiding rotation of the harness support. The rotation guide means may comprise: longitudinal guide holes formed on both sides of each of the longitudinal rectangular plate of the harness support and the backboard; and flanged rod-shaped protrusions passing through the longitudinal guide holes, with a plate-shaped or ring-shaped locking member mounted to an end of each of the flanged rod-shaped protrusions, so that the flanged rod-shaped protrusions move in the longitudinal guide holes during rotation of the harness support.

The protrusions and the locking members may comprise ring nuts flanged at their ends and washer-shaped covers mounted to the ends of the ring nuts using locking screws, respectively. Alternatively, the protrusions and the locking members may comprise pin bolts having heads corresponding to the flanges and threads on ends thereof and nuts tightened to the ends of the pin bolts, respectively. As a further alternative, the protrusions and the locking members may comprise pins having flanges on one ends and circular fitting grooves on the other ends thereof and snap rings fitted over the fitting grooves formed on the ends of the pins, respectively.

The rotary unit may further comprise: a rotating angle control means for controlling the rotating angle of the waist protector. The rotating control means may comprise: the hinge shaft cover having a rectangular shape and mounted to the end of the hinge shaft; and inclined protrusions formed on the backboard on opposite sides of the hinge shaft cover to stop the hinge shaft cover during rotation of the hinge shaft cover, thus causing the waist protector to rotate within an angular range determined by an inclination angle of the protrusions.

The backpack may further comprise: a lift assembly to move the waist protector vertically on the backboard while sliding the protector on the backboard. The lift assembly may comprise: a guide boss protruding from the waist protector to face the rotary unit, thus moving vertically along with the waist protector during vertical movement of the waist protector, with a vertical slot formed on a front surface of the guide boss; a lift guide closely placed on a rear surface of the guide boss; a guide protrusion extending from the lift guide to pass through the vertical slot of the guide boss, and coupled to the rotary unit at an end thereof, thus guiding vertical movement of the guide boss; and a locking member for mounting the guide protrusion of the lift guide to the rotary unit.

The lift assembly may further comprise: a tilting means for tilting the waist protector during forward and backward movement of the waist protector.

The tilting means may comprise: the lift guide having slope surfaces to define a triangular cross-section; and a guide ring member having a triangular cross-section corresponding to the lift guide and fitted over the guide protrusion of the lift guide to be closely placed on the front surface of the guide boss, so that both the lift guide and the guide ring member execute a seesawing motion while supporting the guide boss by protruding parts thereof having the slope surfaces.

The backpack may further comprise: an anti-friction member having a ring shape and fitted over the guide protrusion of the lift guide at a position between the guide boss and the lift guide, thus preventing direct contact of the guide boss with the lift guide.

BEST MODE FOR CARRYING OUT THE INVENTION

Figure 1:
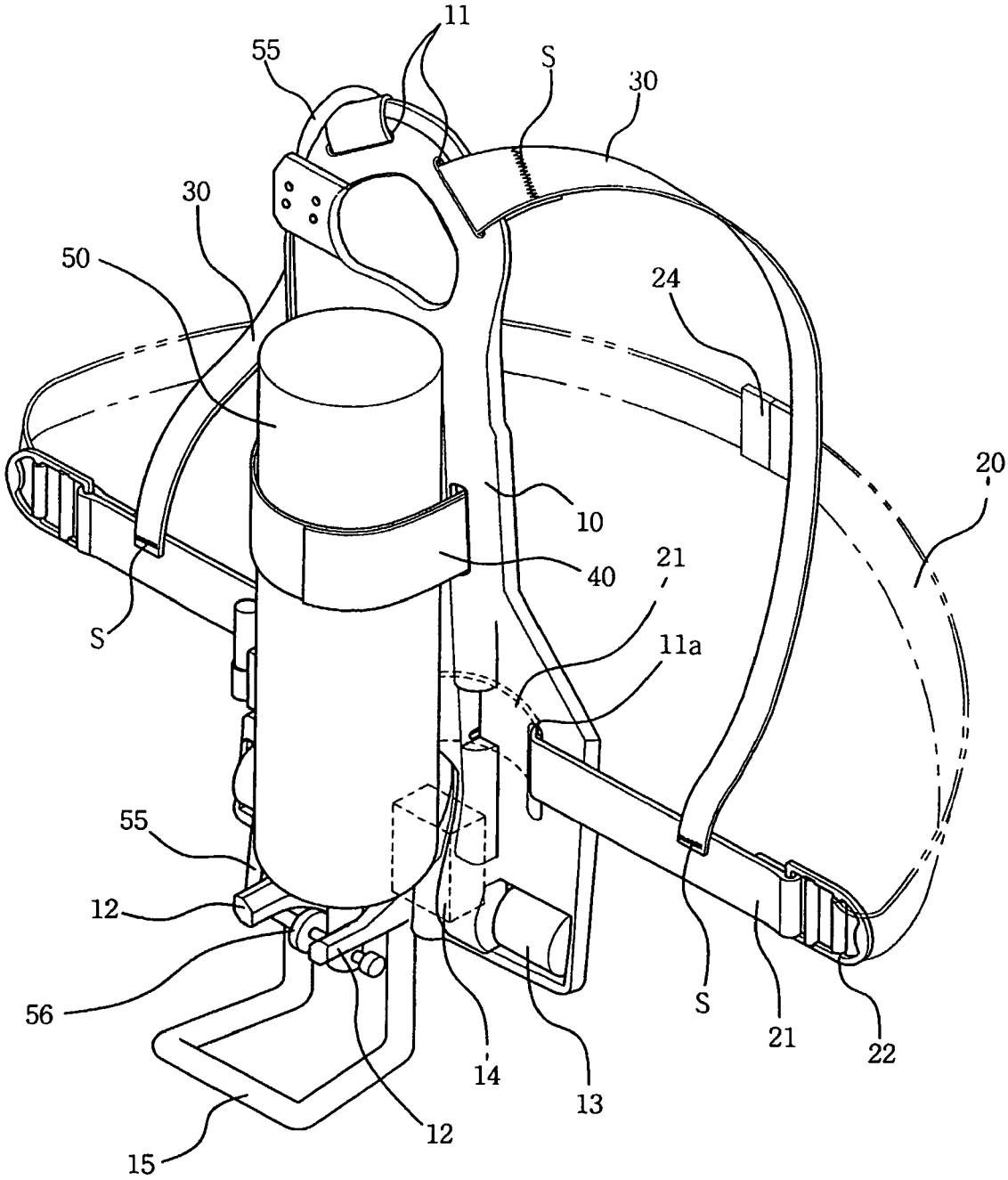
FIG. 1 is a perspective view showing a conventional backpack.

Herein below, a backpack according to the present invention will be described in conjunction with the accompanying drawings. In the following description, the parts common to both the conventional backpack and the backpack according to the present invention will carry the same reference numerals.

Figure 2:
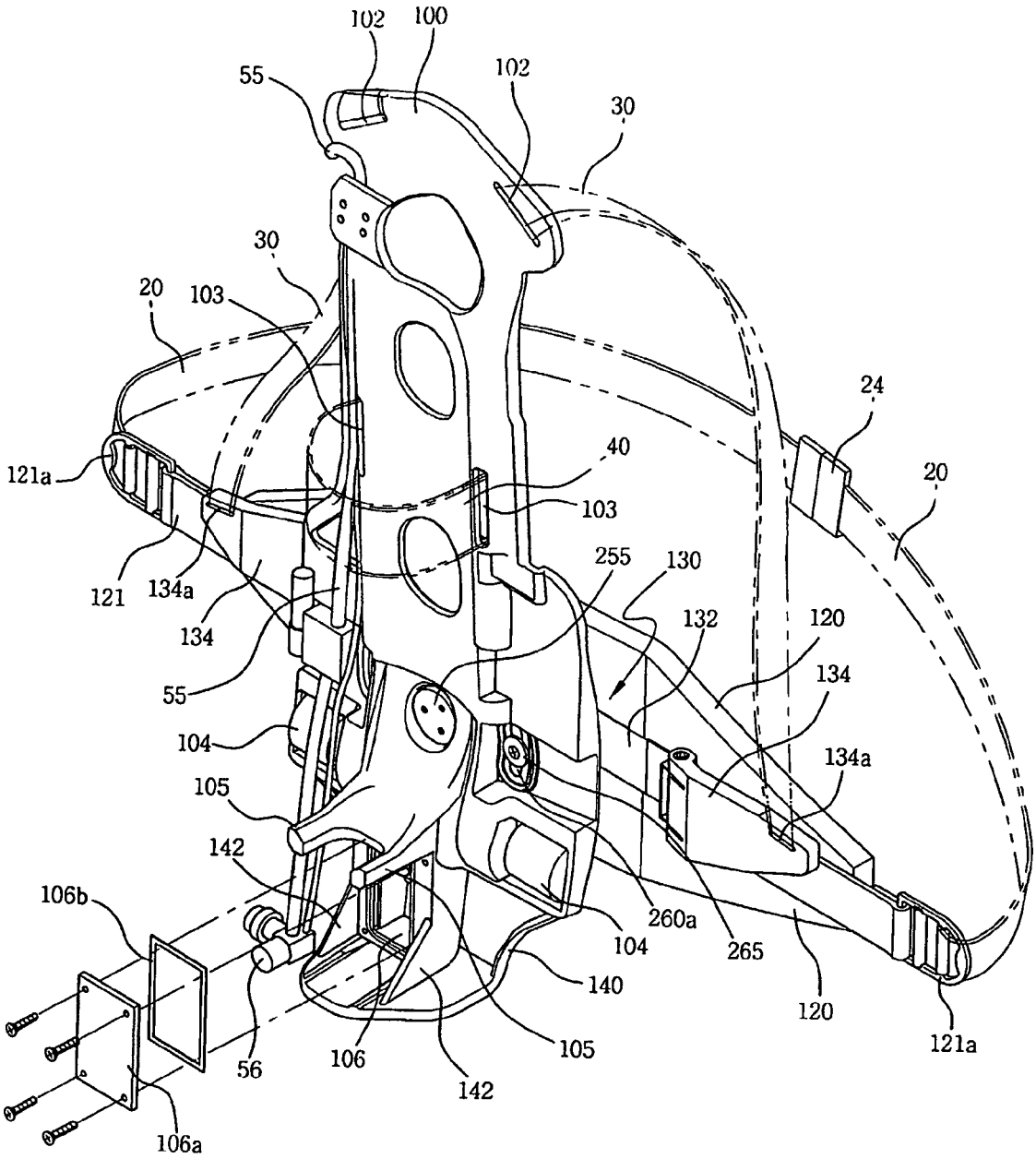
FIG. 2 is a perspective view showing a backpack according to a first embodiment of the present invention.
Figure 3:
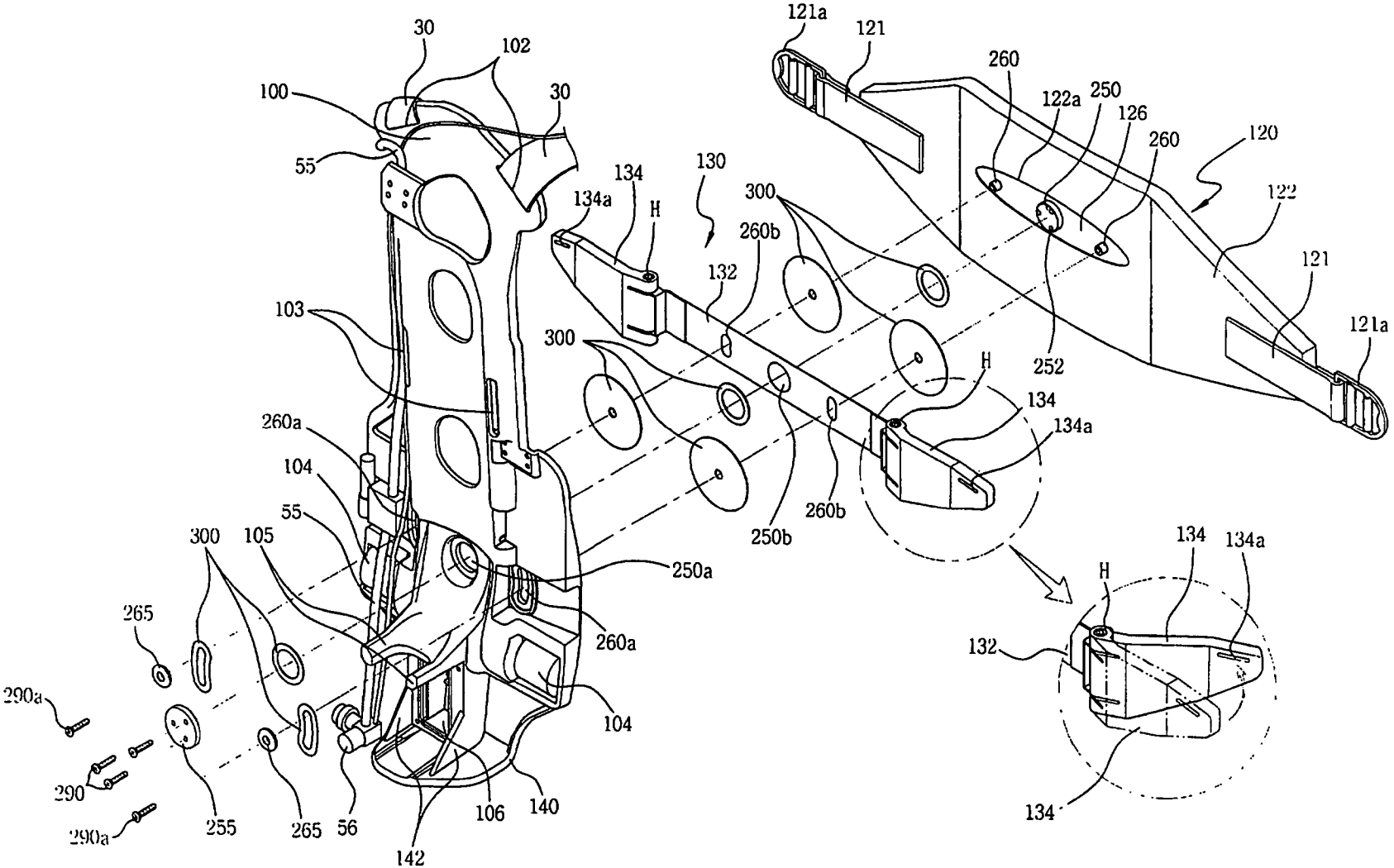
FIG. 3 is an exploded perspective view showing the construction of the backpack of FIG. 2.
Figure 4:
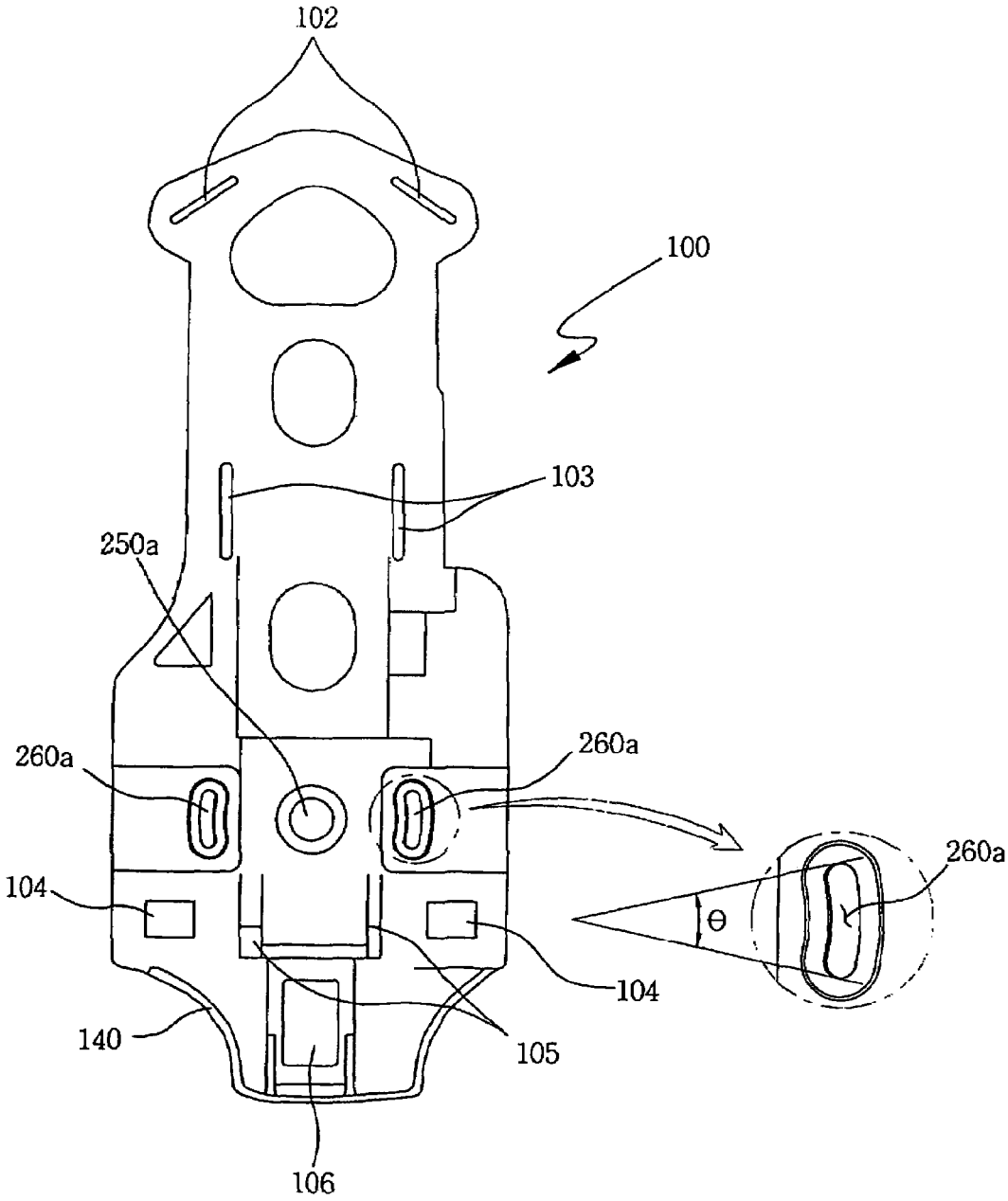
FIG. 4 is a front view showing a backboard shown in FIG. 2.

In the accompanying drawings, FIG. 2 is a perspective view showing a backpack according to a first embodiment of the present invention. FIG. 3 is an exploded perspective view showing the construction of the backpack of FIG. 2. FIG. 4 is a front view showing a backboard shown in FIG. 2.

Figure 5:
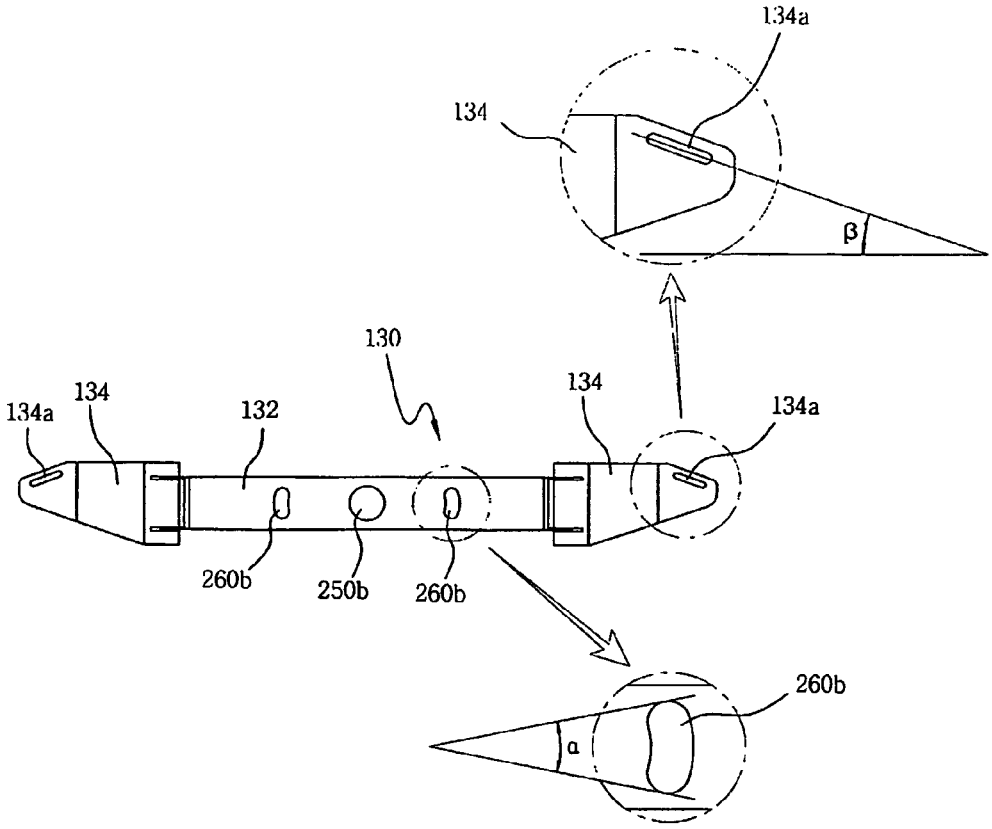
FIG. 5 is a front view of a harness support shown in FIG. 2.
Figure 6:
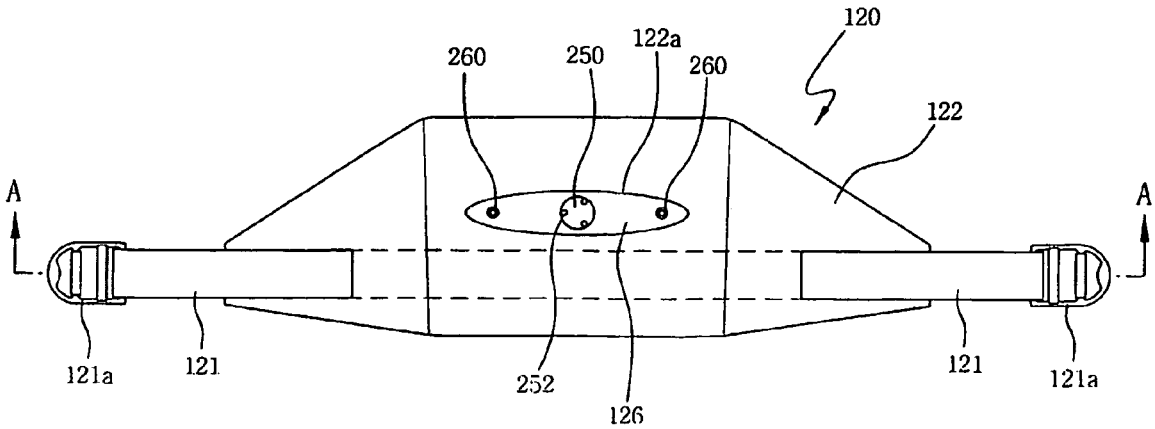
FIG. 6 is a front view of a waist protector shown in FIG. 2.
Figure 7:
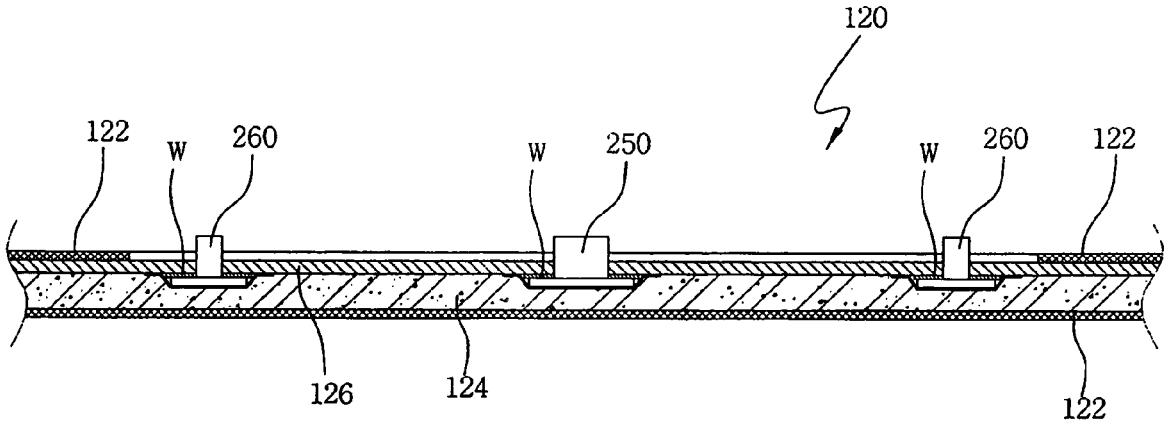
FIG. 7 is a sectional view taken along the line A-A' of FIG. 6, showing a part of the waist protector of FIG. 2.

FIG. 5 is a front view of a harness support shown in FIG. 2. FIG. 6 is a front view of a waist protector shown in FIG. 2. FIG. 7 is a sectional view taken along the line A-A' of FIG. 6, showing a part of the waist protector of FIG. 2.

Figure 8:
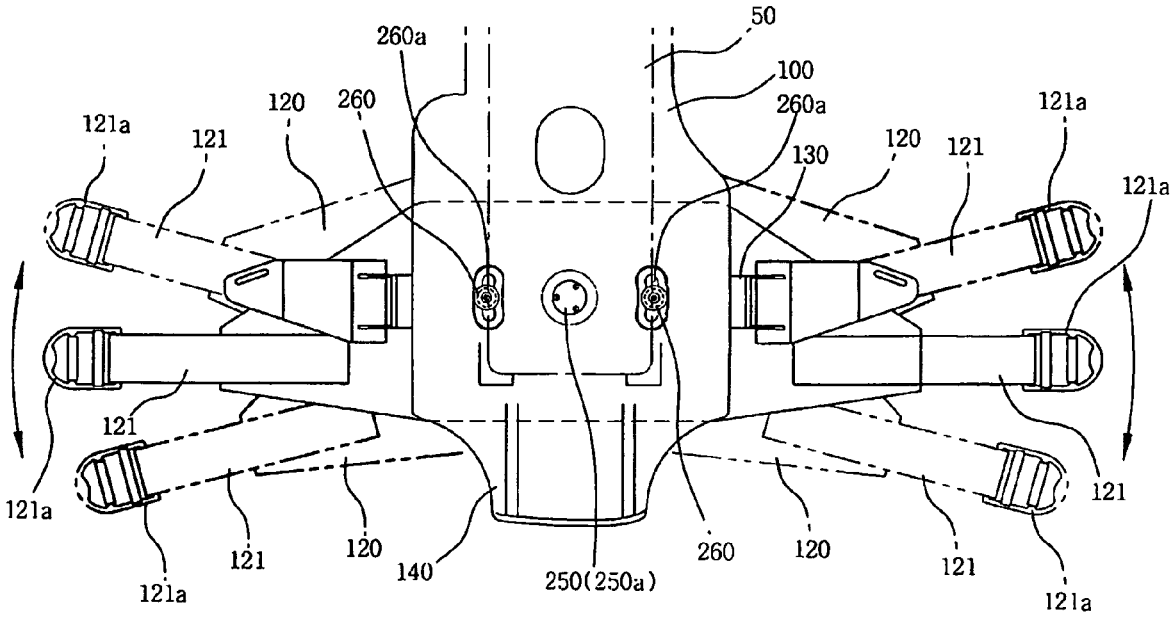
FIG. 8 is a front view showing the operation of the waist protector of FIG. 2.
Figure 9:
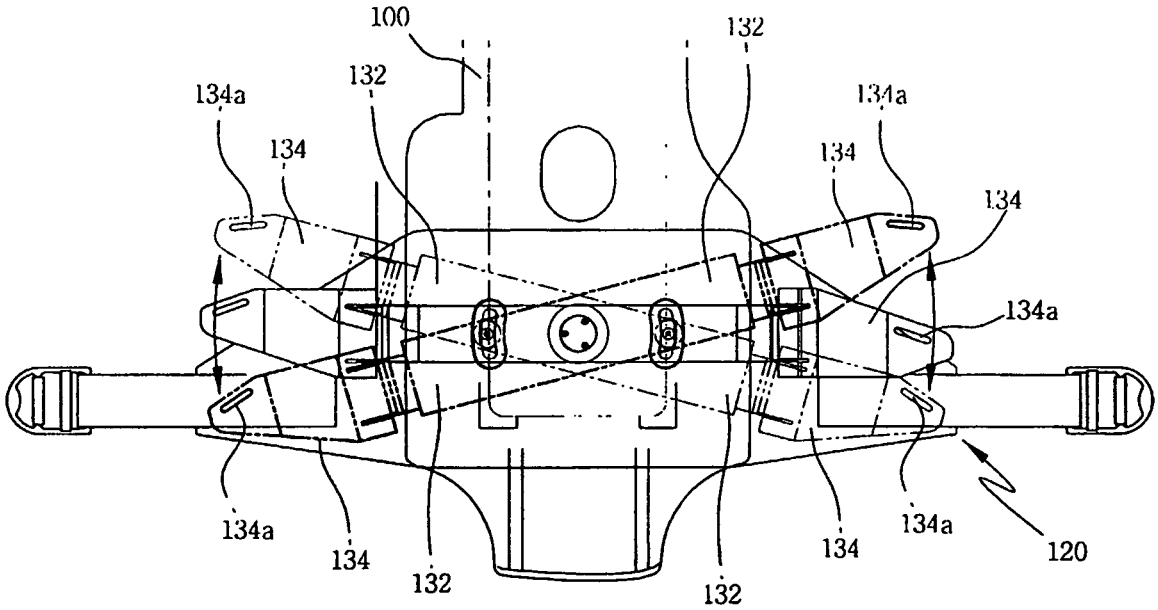
FIG. 9 is a front view showing the operation of the harness support of FIG. 2.
Figure 10:
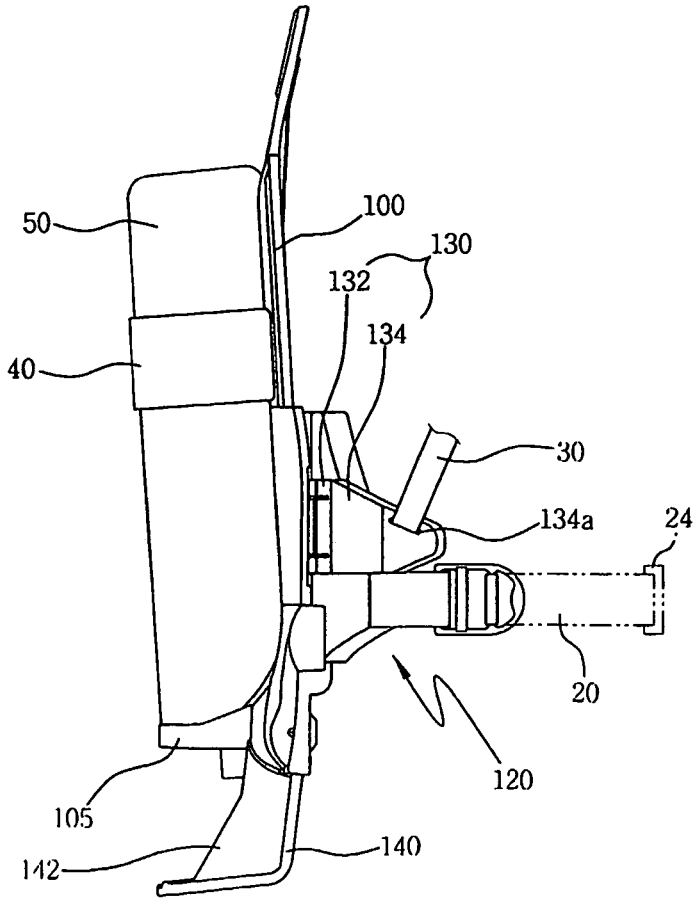
FIG. 10 is a side view showing the state of the backpack according to the first embodiment of the present invention in use.

FIG. 8 is a front view showing the operation of the waist protector of FIG. 2. FIG. 9 is a front view showing the operation of the harness support of FIG. 2. FIG. 10 is a side view showing the state of the backpack according to the first embodiment of the present invention in use.

As shown in FIGS. 2 and 3, the backpack according to the first embodiment of the present invention includes a backboard 100. Harness locking holes 102 are formed on an upper portion of the backboard 100, and support an end of each harness 30 which passes through each locking hole 11. Belt support holes 103 are formed on both sides of a middle portion of the backboard 100, with a cylinder fastening belt 40 sequentially passing through the holes 103 to be supported thereby. The cylinder fastening belt 40 thus fastens a compressed-air cylinder 50 to the backboard while closely passing over an outer surface of the cylinder 50. A pair of support hooks 105 is provided on a lower portion of the backboard 100. The support hooks 105 which are spaced apart from each other protrude from the backboard 100 to support thereon the compressed-air cylinder 50 which is fastened on the backboard 100 by the cylinder fastening belt 40.

In the backpack, the upper portion of the backboard 100 with the harness locking holes 102 has a triangular shape with protruding parts on opposite sides thereof, as shown in the drawing. The harness locking holes 102 are formed on the protruding parts of the triangular upper portion of the backboard 100, respectively. The above-mentioned specified triangular shape of the upper portion of the backboard 100 is designed with the following considerations. That is, when the two harness locking holes 102 are spaced apart from each other by a substantial distance, the harnesses 30 coupled to the harness locking holes 102 can be closely placed around the shoulders of the user back-mounting the backboard 100.

If the backboard 100 does not have such protruding parts on its upper portion, the upper parts of the harnesses 30 are closely placed around the back of the user's neck while forming a V-shaped structure, thus intensively tensioning the back of the user's neck. In the above state, the user is highly stressed to feel severe pain on the back of his/her neck by the upper parts of the harnesses 30.

However, when the upper parts of the harnesses 30 are placed around the shoulders of the user in place of the back of the user's neck, the harnesses 30 press the user's shoulders down in vertical directions. Thus, the pressure imposed on the user by the harnesses 30 is evenly distributed, allowing the user to be free from severe pressure.

As shown in FIGS. 2 and 3, the backboard 100 further includes two flashing lamps 104 which are provided on opposite sides of the lower portion of the backboard 100 to indicate a user's location; and a protective plate 140 which has a predetermined width as shown in FIG. 2 and extends downwards from the lower end of the backboard 100 while bending at its lower part to protrude forwards from the backboard 100 as shown in FIG. 10. The protective plate 140 protects an end of the compressed-air cylinder 50 that is fastened to the backboard 100 and faces the plate 140 at the end.

The protective plate 140 preferably includes a pair of reinforcing ribs 142 that integrally extend along opposite side edges of the forward bending part of the plate 140 to increase the strength of the plate 140 in a vertical direction; and a battery casing 106 for installation of batteries therein to supply electricity to the flashing lamps 104 of the backboard 100. The battery casing 104 is provided between the pair of reinforcing ribs 142 which protect opposite sides of the battery casing 106.

The reinforcing ribs 142 increase the strength of the protective plate 140 as described above, and thus, the plate 140 is prevented from breakage caused by buckling. Furthermore, the reinforcing ribs 142 define a space between them for installation of the batteries for the flashing lamps 104. In other words, the battery casing 106 is provided in the space defined between the two reinforcing ribs 140. Of course, to prevent the batteries from being undesirably ejected from the battery casing 106, a casing cover 106*a* must be mounted to the battery casing 106 as shown in the drawing. To make the cover 106*a* waterproof, the cover 106 preferably has a waterproof packing 106*b*.

The backpack of the present invention further includes a longitudinal harness support 130 as shown in FIGS. 2 and 3. The harness support 130 is coupled to the lower portion of the back surface of the backboard 100, with opposite arms of the support 130 extending horizontally in opposite directions. In the above state, the longitudinal harness support 130 rotates upwards and downwards around the center. The ends of the harnesses 30 are coupled to the opposite arms of the harness support 130, respectively.

As shown in FIG. 5, the harness support 130 comprises a longitudinal rectangular plate 132 which is an elastic body to elastically bend to encircle the waist of the user. The rectangular plate 132 is coupled to the backboard 100 to rotate upwards and downwards around its center. The harness support 130 further includes a harness coupling bracket 134 which is coupled by a hinge H to each end of the longitudinal rectangular plate 132, thus bending forwards and backwards around the hinges H. The harness coupling bracket 134 has a harness coupling hole 134*a*. The other end of each harness 30 is inserted into the harness coupling hole 134*a* to be locked thereto.

The rectangular plate 132 is the longitudinal body as shown in the drawing, with elasticity provided in the plate 132. When the user wears the harnesses 30 on his/her shoulders, both ends of the rectangular plate 132 bend in a backward direction like a braced bow due to tension caused by the ends of the harnesses 30. In other words, when wearing the harnesses 30, the ends of the harnesses 30 strain the harness coupling brackets 134 of the rectangular plate 132, thus bending the rectangular plate 132. Therefore, the harnesses 30 are comfortably worn on the shoulders so that the stress acting on the user caused by the wearing of the harnesses 30 may be minimized.

The harness coupling hole 134*a* of each harness coupling bracket 134 is preferably designed as a longitudinal hole extending along the upper edge of the bracket 134 as shown in FIGS. 2 and 3. Particularly, the harness coupling hole 134*a* is preferably inclined downwards in a direction from the inside to the outside part of the bracket 134 at an inclination angle β of 22°~55° relative to a horizontal axis as shown in FIG. 5. Due to the inclination angle β, the end of each harness 30 is preferably coupled in an inclined position to the bracket 134.

Due to the inclination of the lower ends of the harnesses 30, the harnesses 30 are more comfortably worn on the user's shoulders, thus allowing the user to more conveniently and comfortably back-mount the backpack. Of course, the above-mentioned advantage of the harnesses 30 is caused by the structure whereby the ends (lower ends) of the harnesses 30 are inclined, so as to be free from being twisted when the user wears the harnesses 30.

However, if the fixed lower ends of the harnesses 30 are placed horizontally in the same manner as conventional backpacks, the harnesses 30 may be badly twisted to press or interfere with the sides of the user, thus making the user back-mounting the backpack very uncomfortable and stressed. However, the present invention prevents such twisting of the harnesses to release the user from such discomfort or stress.

Furthermore, as shown in FIGS. 2 and 3, a waist protector 120 to cover and protect the back of the user's waist is coupled to the backboard 100 at a position in the back of the harness support 130. Both ends of the waist protector 120 rotate upwards and downwards around the center of the protector 120, with ends of a waist belt 20 coupled to both ends of the waist protector 120 respectively.

A clip 121*a* is coupled to each end of the waist protector 120 as shown in FIG. 6, and is coupled to each end of the waist belt 20. As shown in the drawing, the clip 121*a* may be attached to each end of a connection band 121 which is supported by the waist protector 120 while passing through the protector 120. Alternatively, the clip 121*a* may be directly attached to each end of the waist protector 120 to form a single structure different from the structure shown in the drawing. In the embodiment, the clips 121*a* are coupled to each end of the waist protector 120 by means of the connection band 121, while the clips 121*a* couple the waist belt 20 to the waist protector 120 to form a single body.

As shown in FIGS. 6 and 7, the waist protector 120 preferably comprises a plate-shaped cushion member 124; a plastic support panel 126 which is closely mounted to a surface of the cushion member 124 and has a predetermined strength to prevent buckling of the cushion member 124; and a flame retardant soft cover 122 which covers both the cushion member 124 and the plastic support panel 126, with an opening 122*a* formed on a predetermined portion of a surface of the flame retardant soft cover 122 to expose a part of the central portion of the support panel 126 to the outside. In the waist protector 120, the flame retardant soft cover 122 is preferably made of a fabric formed of a flame retardant material or coated with a flame retardant.

Furthermore, the backpack of the present invention includes a rotary unit which rotatably supports both the harness support 130 and the waist protector 120 on the backboard 100 (thus, the harness support 130 and the waist protector 120 rotate around the centers thereof).

As shown in FIGS. 3 and 7, the rotary unit includes a hinge shaft 250 which protrudes from the center of the waist protector 120 and sequentially passes through the center of the harness support 130 and the center of the lower portion of the backboard 100, thus serving as a rotating shaft around which both the waist protector 120 and the harness support 130 rotate.

As shown in FIG. 3, the rotary unit further includes a hinge shaft cover 255 which has a diameter larger than the diameter of the hinge shaft 250, and is integrated with the hinge shaft 250 into a single structure at a position in front of the backboard 100, thus rotatably coupling the hinge shaft 250 to the backboard 100.

The rotary unit also includes a plurality of locking members 290 which pass through the hinge shaft cover 255 and are tightened to the hinge shaft 250 as shown in FIG. 3, thus locking the hinge shaft cover 255 to the hinge shaft 250.

In the above state, to allow the hinge shaft 250 to pass through, the harness support 130 and the backboard 100 must be provided with hinge shaft passing holes 250*a* and 260*b*. The diameter of the hinge shaft cover 255 is larger than the diameters of the hinge shaft passing holes 250*a* and 260*a* so that the hinge shaft 250 rotates while being supported by the backboard 100.

Therefore, due to the hinge shaft cover 255 which is coupled to the hinge shaft 250 by means of the locking members 290, the hinge shaft 250 is rotatably coupled to both the harness support 130 and the backboard 100. The harness support 130 and the waist protector 120 rotate around the hinge shaft 250.

As shown in FIG. 7, the hinge shaft 250 has a flange on a side thereof and is attached to the cushion member 124 of the waist protector 120 by the flange using double-sided adhesive tape. The hinge shaft 250 is thus mounted to the waist protector 120, and passes through the support panel 126 which is closely mounted to the cushion member 124, and projects outside the opening 122*a* of the flame retardant soft cover 122.

In FIG. 7, the reference character W denotes a washer which is fitted over the hinge shaft 250 and is interposed between the flange of the hinge shaft 250 and the support panel 126 of the waist protector 120, thus preventing the flange of the hinge shaft 250 from being removed from the support panel 126 when the hinge shaft 250 is placed to pass through the support panel 126. The above-mentioned washer W is preferably used when the flange of the hinge shaft 250 has a small size. If the flange has a large diameter like the washer W shown in the drawing, the washer W may not be used in the structure.

In the meantime, the rotary unit of the backpack of the present invention may further include a rotation guide means which guides the rotation of both the waist protector 120 and the harness support 130, and controls the rotating angles of them.

As shown in FIGS. 3 and 7, the rotation guide means comprises two guide protrusions 260 which are provided on opposite sides of the waist protector 120 and individually have an inner thread. Two first and two second longitudinal guide holes 260*a* and 260*b*, which have an arc-shaped appearance and through which the two guide protrusions 260 pass, are formed on the opposite sides of the lower portion of the backboard 100 and the opposite sides of the harness support 130, respectively. After the two guide protrusions 260 have sequentially passed through the first and second guide holes 260*a* and 260*b*, protrusion covers 265 are preferably mounted to the guide protrusions 260 using locking screws 290*a* as shown in FIG. 3. In the above state, the protrusion covers 265 have an outer diameter larger than the width of the first guide holes 260*a*.

Thus, the guide protrusions 260 move upwards and downwards along the first and second guide holes 260*a* and 260*b* during rotation of both the waist protector 120 and the harness support 130. In the above state, the rotating angles of both the waist protector 120 and the harness support 130 are limited by the guide protrusions 260, so that both the waist protector 120 and the harness support 130 are prevented from rotating at 360°.

In the present invention, as shown in FIGS. 4 and 5, the first guide holes 260*a* formed on the backboard 100 and the second guide holes 260*b* formed on the harness support 130 are preferably designed to have arc angles θ (22°~28°) and α (7°~13°), respectively, around the center of the hinge shaft 250 passing through the backboard 100. Thus, the arc angles 0 and a determine the lengths of the first and second guide holes 260*a* and 260*b*.

When setting the arc angles θ and α to 22°~28° and 7°~13°, respectively, the waist protector 120 and the harness support 130 rotate within specified angular ranges determined by the arc angles θ and α. Of course, the arc angles θ and α are designed in consideration of the motions of the arms and waists of the users, and thus, the users can use the backpack comfortably.

The rotation of the waist protector 120 and the harness support 130 according to the arc angles θ and α will be described in detail herein below with reference to FIGS. 8 and 9. In the following description, the arc angles θ and α of the waist protector 120 and the harness support 130 are set to 22° and 7°, respectively.

First, as shown in FIG. 8, the waist protector 120 rotates around the hinge shaft 250 at 22° due to the arc angle θ (set to 22°) of the first guide holes 260*a* formed on the backboard 100. In the meantime, as shown in FIG. 9, the harness support 130 rotates around the hinge shaft 250 at 7° due to the arc angle α of the second guide holes 260*b*. However, due to the arc angle θ (set to 22°) of the first guide holes 260*a* of the backboard 100, the harness support 130 further rotates around the hinge shaft 250 at 22°. In other words, because the harness support 130 is separated from the waist protector 120, the harness support 130 further rotates at the arc angle θ of the first guide holes 260*a*.

Thus, the user of the backpack comfortably moves his/her waist within a range allowed by the rotating angle of the waist support 120, and moves his/her shoulders and arms more comfortably within ranges wider than that of his/her waist. The user thus moves his/her body almost freely while back-mounting the backpack.

In the meantime, the guide protrusions 260 of the rotation guide means are provided on a side thereof with a flange in the same manner as that described for the hinge shaft 250. As shown in FIG. 7, the flange of the guide protrusions 260 is attached to the cushion member 124 of the waist protector 120 using double-sided adhesive tape. When the flange of the guide protrusions 260 is attached to the cushion member 124, the guide protrusions 260 pass through the support panel 126 and project outside the opening 122*a* of the flame retardant soft cover 122. In the above case, washers W may be fitted over the guide protrusions 260 in the same manner as that of the hinge shaft 250.

In the drawings which have been referred to in the above description for the construction of the backpack, the reference numeral 300 denotes anti-friction members made of plastic or stainless steel which are fitted over the hinge shaft 250 and the guide protrusions 260 while being interposed between the waist protector 120, the harness support 130, the backboard 255 and the protrusion covers 255 as shown in FIG. 3.

Furthermore, the reference numeral 55 denotes an air hose to supply air from the compressed-air cylinder 50 to the user, and the numeral 56 denotes a regulator 56 to regulate the pressure of the compressed air supplied from the cylinder 50.

The operation of the backpack having the above-mentioned construction according to the first embodiment of the present invention will be described herein below with reference to FIGS. 8 to 10.

First, the user of the backpack according to the first embodiment of the present invention fastens the compressed-air cylinder 50 to the backboard 100 using the cylinder fastening belt 40, and thereafter, stands the backboard 100 vertically while placing the protective plate 140 on the ground surface or the surface of a table, prior to wearing the shoulder harnesses 30.

When the protective plate 140 is placed on the ground surface or the table surface, the lower part of the backboard 100 may collide on the ground surface or the table surface due to the heavy weight of the air cylinder 50. In the above state, impact may be applied to the lower part of the backboard 100. However, the protective plate 140 of the backpack absorbs the impact to protect the regulator 56 of the air cylinder 50 from the impact.

Furthermore, the user of the backpack easily wears the shoulder harnesses 30, due to the harness coupling brackets 134 which are coupled to the harness support 130 and able to bend forwards and backwards, and the harness coupling holes 134*a* which are formed on the harness coupling brackets 134 and have a downward inclination angle β.

After wearing the harnesses 30, the user encircles his/her waist with the waist belt 20 coupled to the waist protector 120 and fastens the waist belt 20 using the buckle 24. Thus, the backpack of the present invention is back-mounted by the user with the compressed-air cylinder 50 fastened to the backpack. In the above case, even though the user back-mounts the heavy air cylinder 50, the backpack is not hard on the user's back due to the cushion member 124 of the waist protector 120.

As shown in FIGS. 8 and 9, the waist protector 120 and the harness support 130 independently rotate due to both the rotary unit and the rotation guide means which are the hinge shaft 250 and the guide protrusions 260 inserted in the first and second guide holes 260*a* and 260*b*. Of course, both the waist protector 120 and the harness support 130 move separately from the backboard 100. In other words, the backboard 100 does not interfere with the waist protector 120 or the harness support 130 even when the protector 120 and the support 130 rotate.

Because the waist protector 120 and the harness support 130 independently rotate as described above, the user back-mounting the backpack freely and comfortably moves without being restricted by the waist belt 20 or the harnesses 30.

Particularly, the backboard 100 does not interfere with the waist protector 120 or the harness support 130, and the compressed-air cylinder so fastened to the backboard 100 does not move even though the user moves his/her waist and/or arms. Thus, the center of gravity of the air cylinder 50 is not shifted regardless of the movement of the user.

Because the backpack stably holds the compressed-air cylinder 50 without allowing the center of gravity of the air cylinder 50 to shift, the user moves more freely without falling due to a shift of the center of gravity of the air cylinder 50.

When the user wears the backpack of the present invention, the flashing lamps 104 provided on the backboard 100 are turned on to indicate the user's location. In the above state, electricity is supplied from the batteries installed in the battery casing 106 to the flashing lamps 104.

The batteries installed in the battery casing 106 may be easily exchanged for new ones after opening the cover 106*a* which covers the battery casing 106. Furthermore, because the battery casing 106 is provided on the front surface of the backboard 100 to which the compressed-air cylinder 50 is fastened, the user more easily exchanges the batteries for new ones.

In other words, if the battery casing 106 is provided on the back surface of the backboard 100 in a conventional manner, the user must remove the backpack when needing to exchange the batteries for new ones. However, the battery casing 106 of the present invention is provided on the front surface of the backboard 100, and thus, the exchange of the batteries is easily carried out.

As described above, the backpack of the present invention flashes light from the flashing lamps 104, and thus, other persons easily determine the location of the user wearing the backpack. Thus, the user wearing the backpack and the other persons around the user work at the scene of danger while frequently checking their locations. Further, the user should frequently check the amount of air remaining in the compressed-air cylinder 50 fastened to the backboard 100 while working.

Of course, an alarm unit (not shown), such as a whistle, to inform the user of a low amount of the compressed air remaining in the air cylinder 50, is mounted on the air hose 55 connected to the compressed-air cylinder 50. However, in addition to the alarm unit, it is recommended to frequently check the amount of compressed air remaining in the air cylinder 50 in an effort to ensure the safety of the user. The user must move from the dangerous place to another place with a sufficient amount of fresh air when the alarm unit generates an alarm signal. Further, the user should frequently check the amount of air remaining in the compressed-air cylinder 50 while working.

The protective plate 140 of the backpack according to the present invention has a plate shape, and thus, the protective plate 140 does not catch on any protruding objects, such as steel reinforcing bars, while the user with the backpack on his/her back moves around. Furthermore, the protective plate 140 protects both the compressed-air cylinder 50 and the regulator 56 from protruding objects.

In addition, as the lower ends of the shoulder harnesses 30 are mounted to the harness coupling holes 134*a* of the harness support 130 while being inclined, the backpack provides a large range within which the user of the backpack can comfortably move his/her shoulders without being disturbed.

FIGS. 11 through 22 show a backpack according to the second embodiment of the present invention. Herein below, the backpack according to the second embodiment will be described with reference to the accompanying drawings. In the following description, the elements of the second embodiment analogous to those of the first embodiment will carry the same reference numerals as the first embodiment, while the elements of the second embodiment different from the first embodiment will be specified by "500" series reference numerals.

Figure 11:
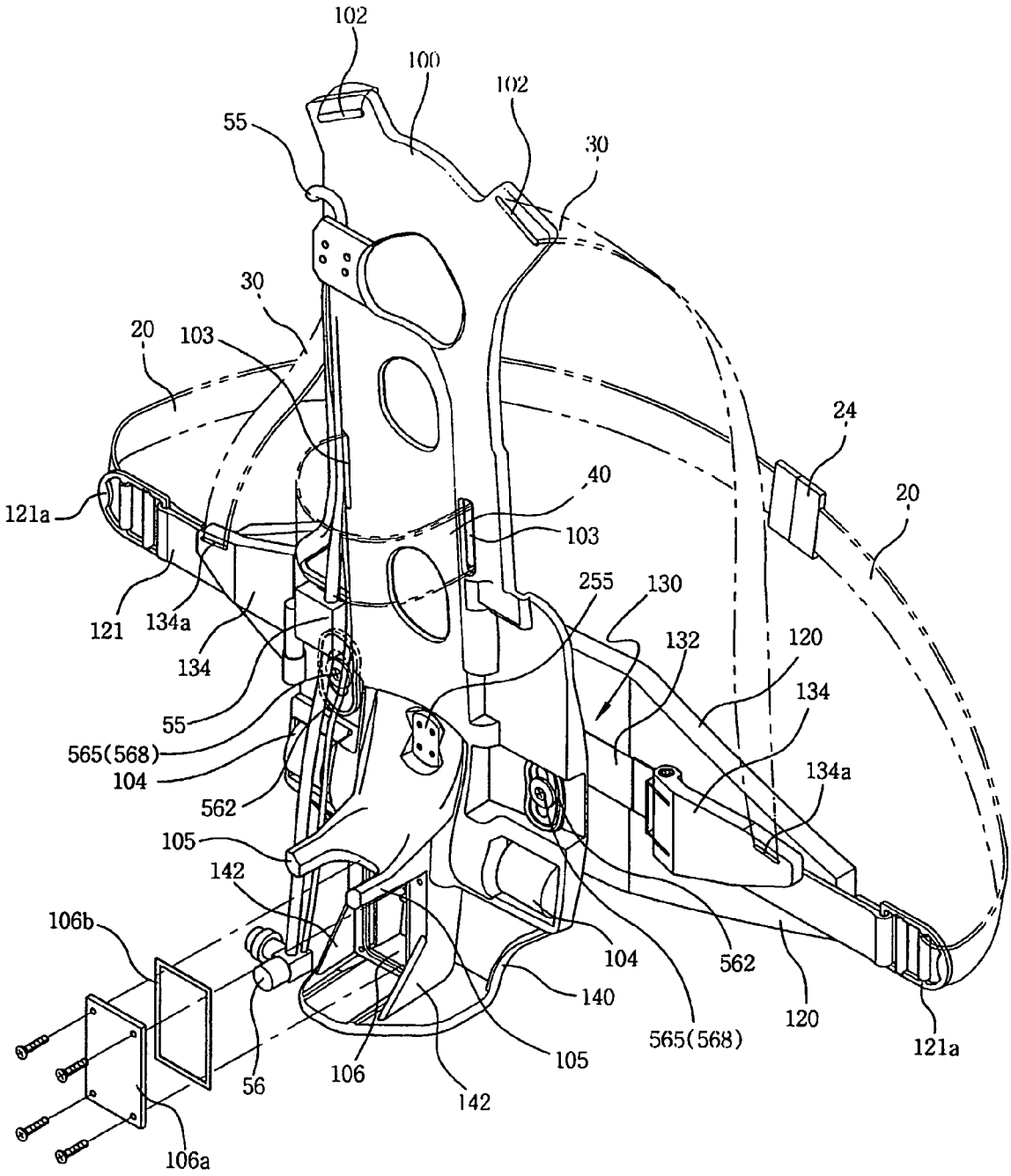
FIG. 11 is a perspective view showing a backpack according to a second embodiment of the present invention.
Figure 12:
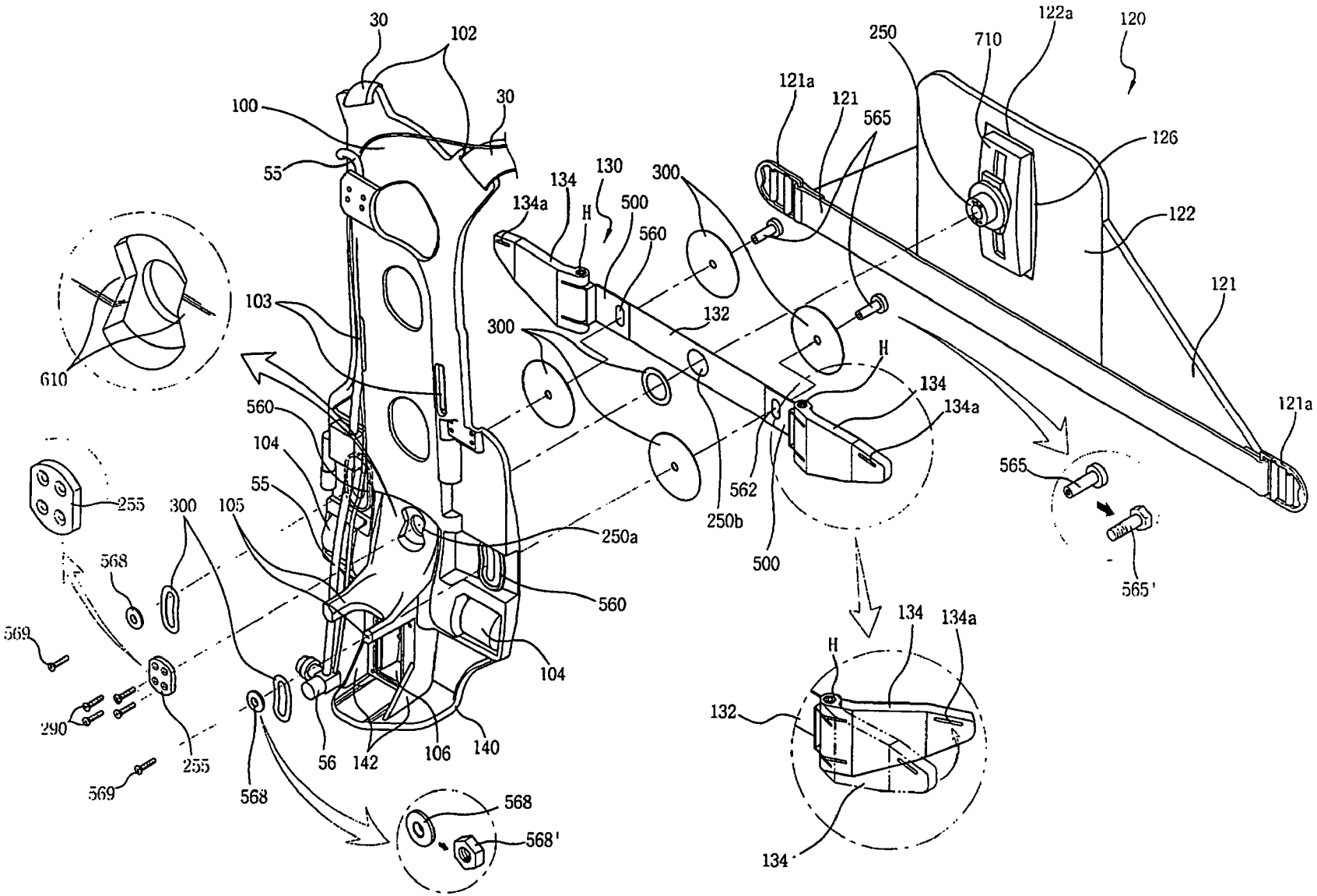
FIG. 12 is an exploded perspective view of the backpack of FIG. 11.
Figure 13:
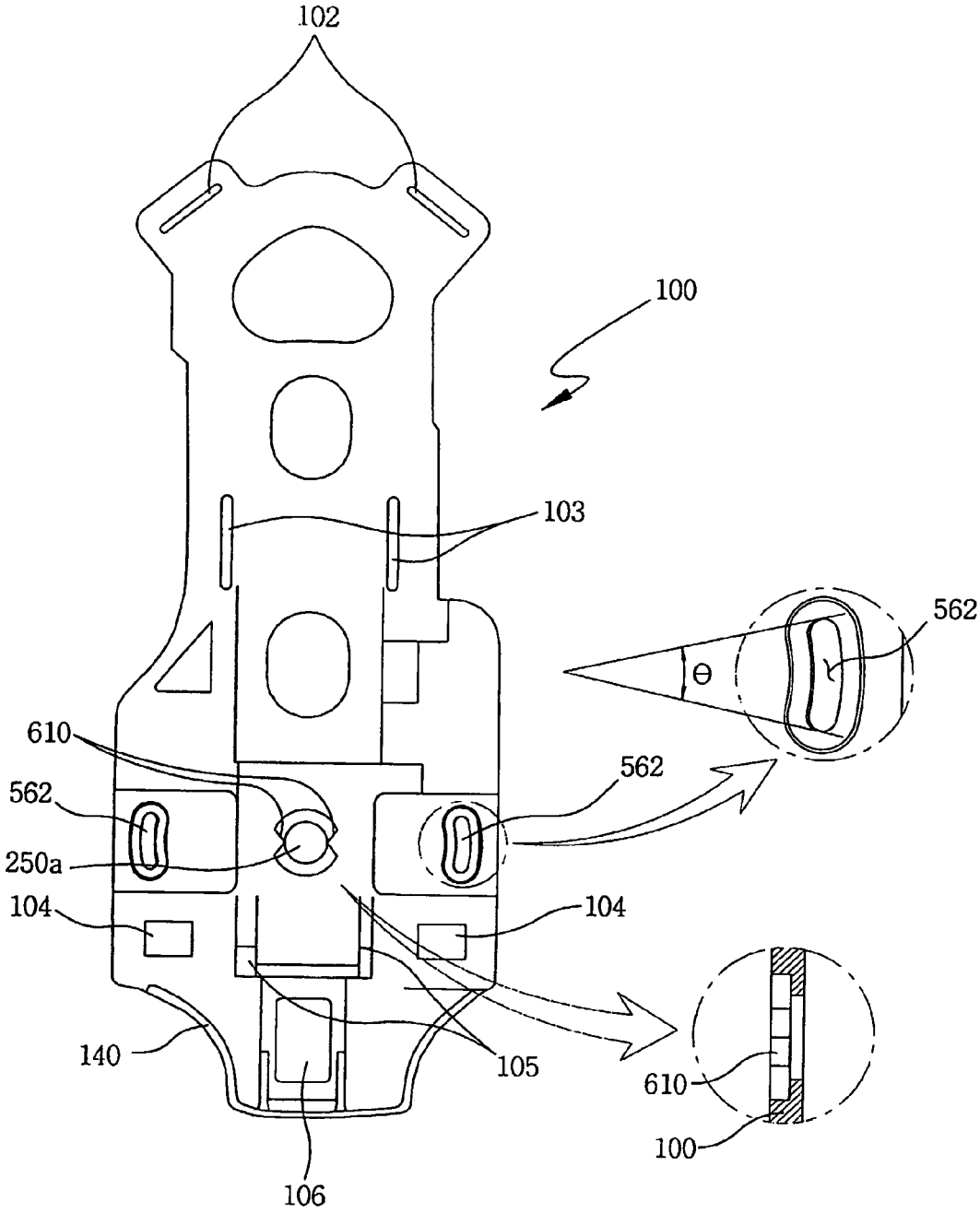
FIG. 13 is a front view of a backboard shown in FIG. 11.

FIG. 11 is a perspective view showing the backpack according to the second embodiment of the present invention. FIG. 12 is an exploded perspective view of the backpack of FIG. 11. FIG. 13 is a front view of a backboard shown in FIG. 11.

Figure 14:
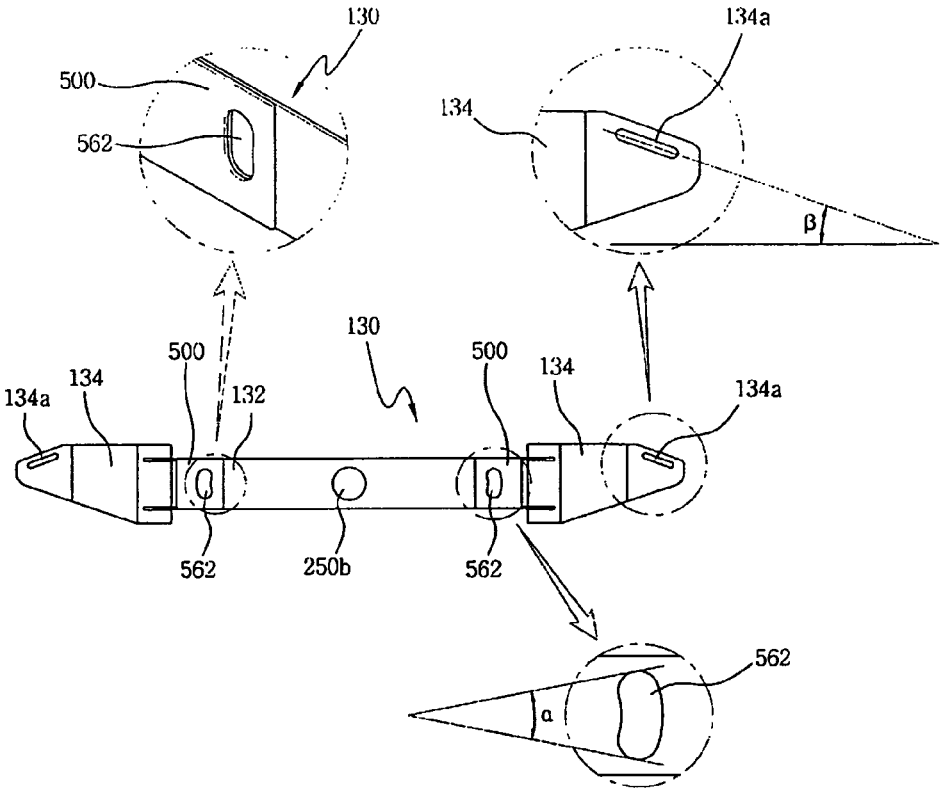
FIG. 14 is a front view of a harness support shown in FIG. 11.
Figure 15:
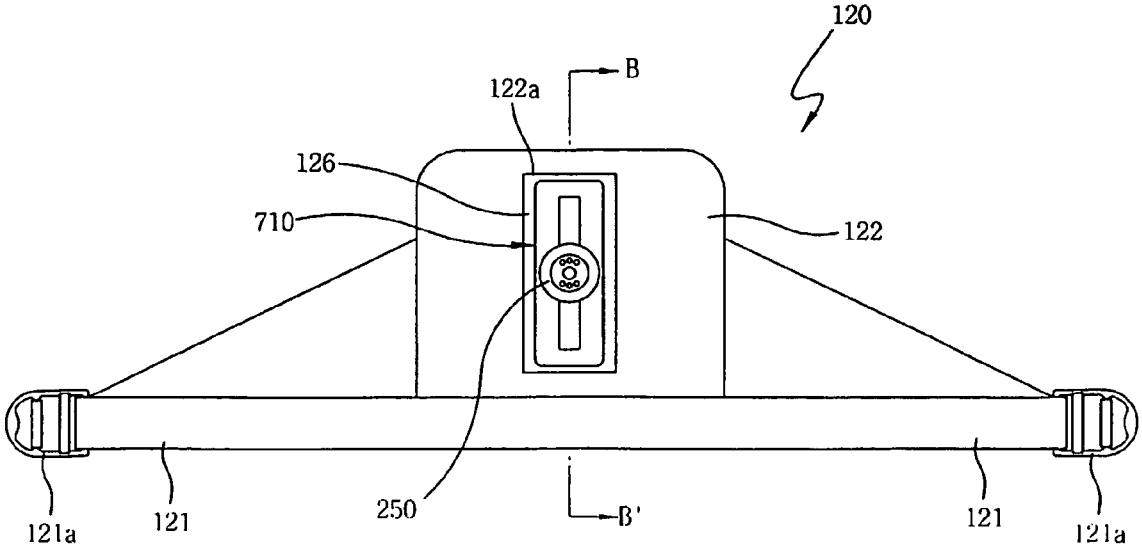
FIG. 15 is a front view of a waist protector shown in FIG. 11.
Figure 16:
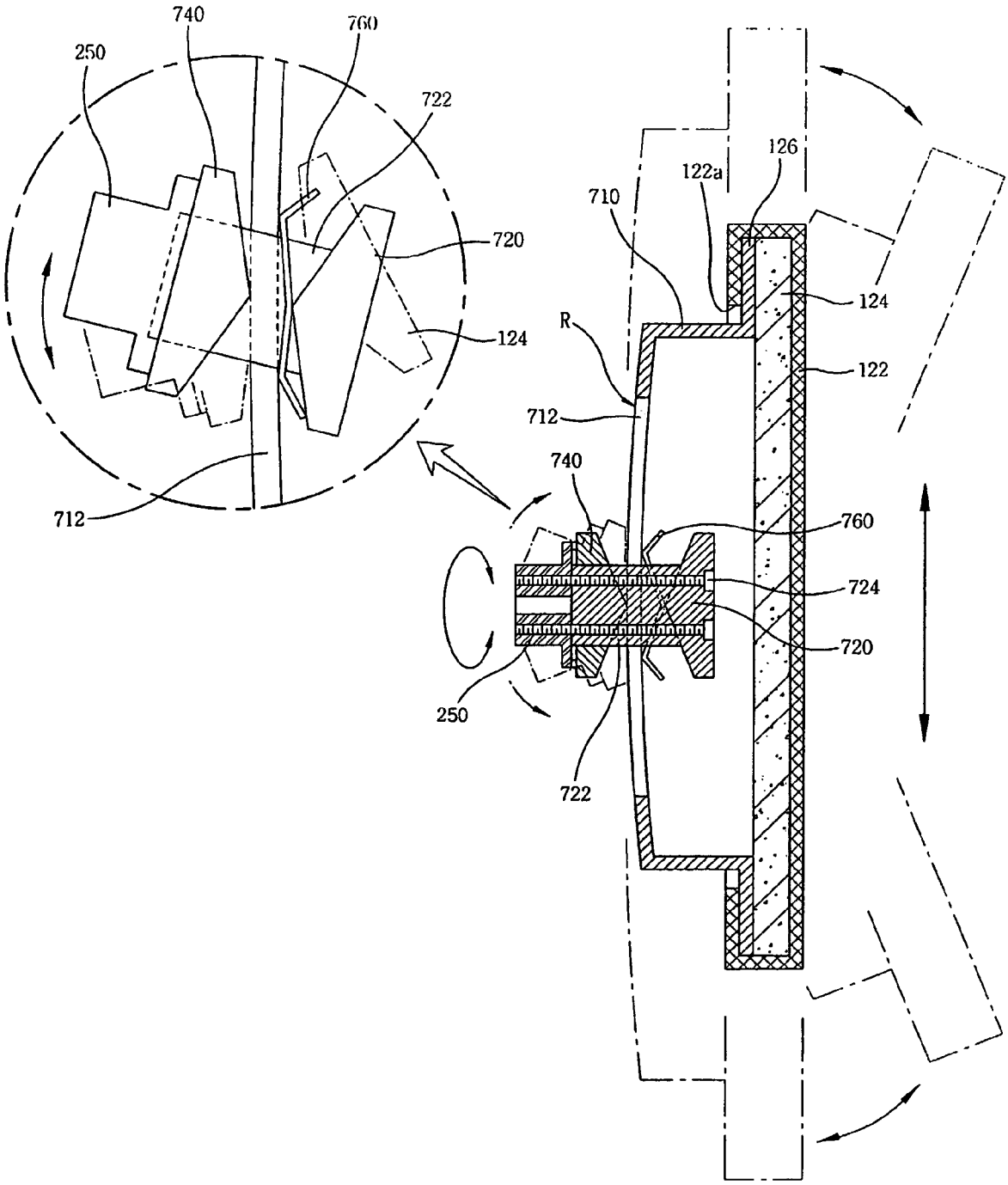
FIG. 16 is a sectional view taken along the line B-B' of FIG. 15.
Figure 17:
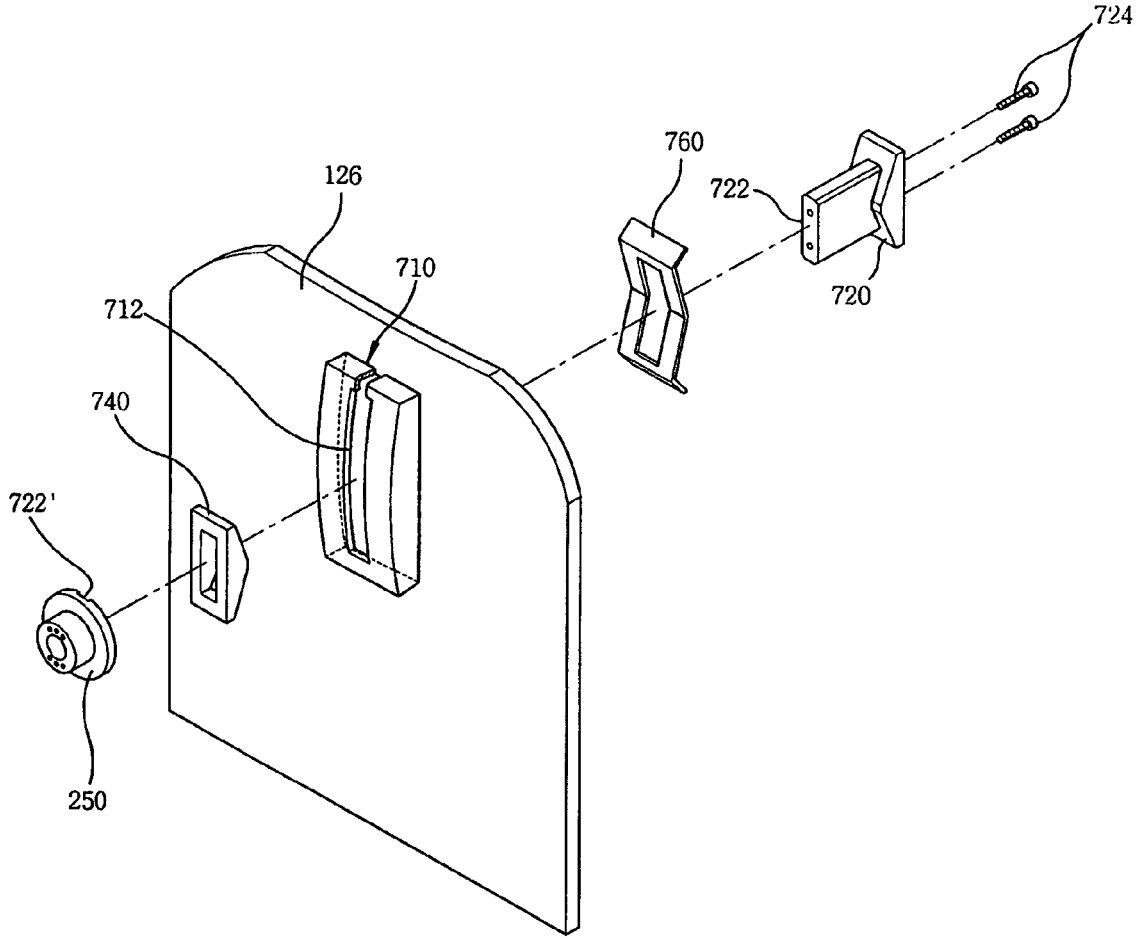
FIG. 17 is an exploded perspective view of a lift assembly shown in FIG. 15.
Figure 18:
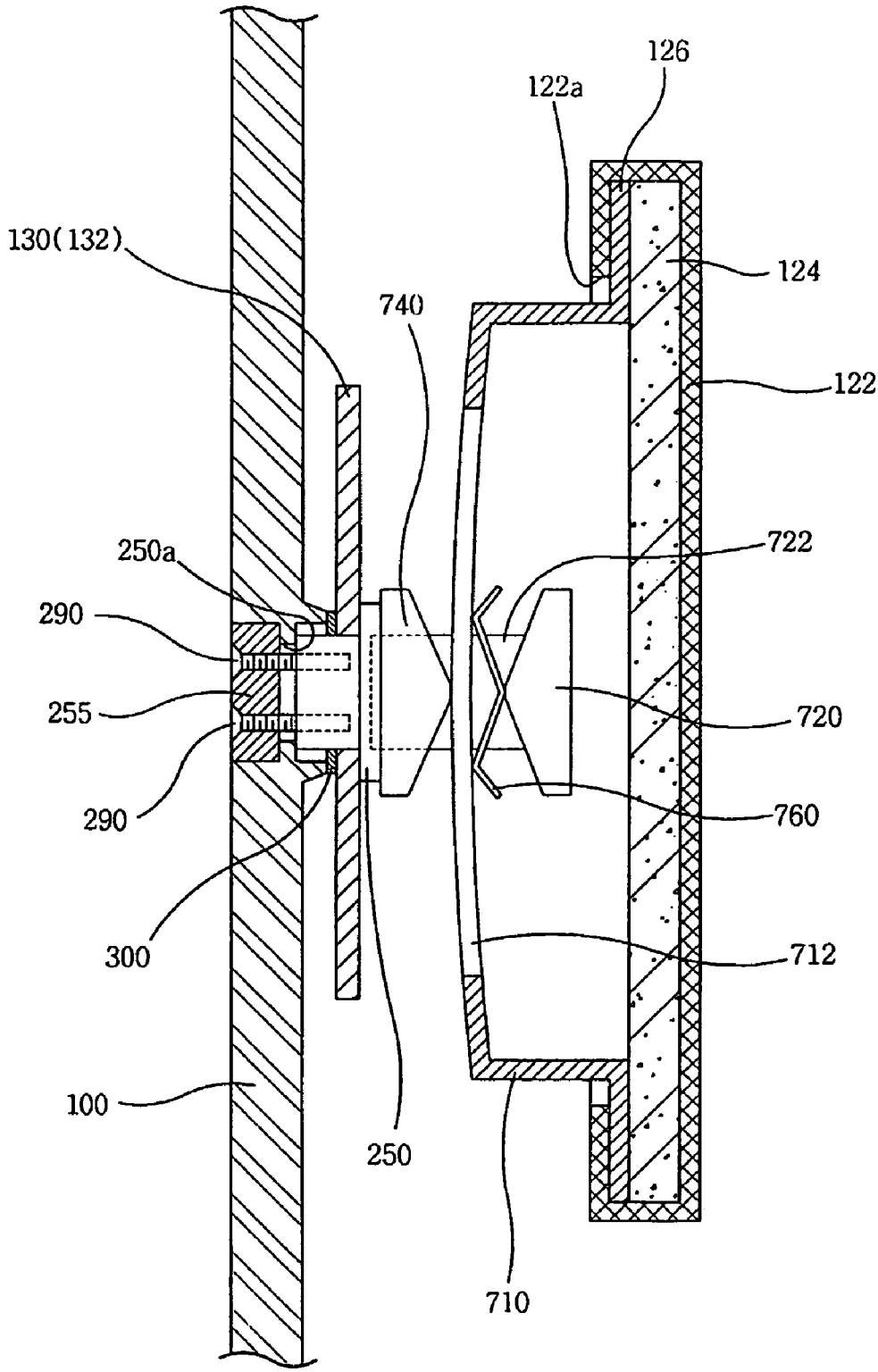
FIG. 18 is a longitudinal sectional view showing a coupled state of the backboard, harness support and waist protector shown in FIG. 11.

In addition, FIG. 14 is a front view of a harness support shown in FIG. 11. FIG. 15 is a front view of a waist protector shown in FIG. 11. FIG. 16 is a sectional view taken along the line B-B' of FIG. 15. FIG. 17 is an exploded perspective view of a lift assembly shown in FIG. 15. FIG. 18 is a longitudinal sectional view showing a coupled state of the backboard, harness support and waist protector shown in FIG. 11.

Figure 19:
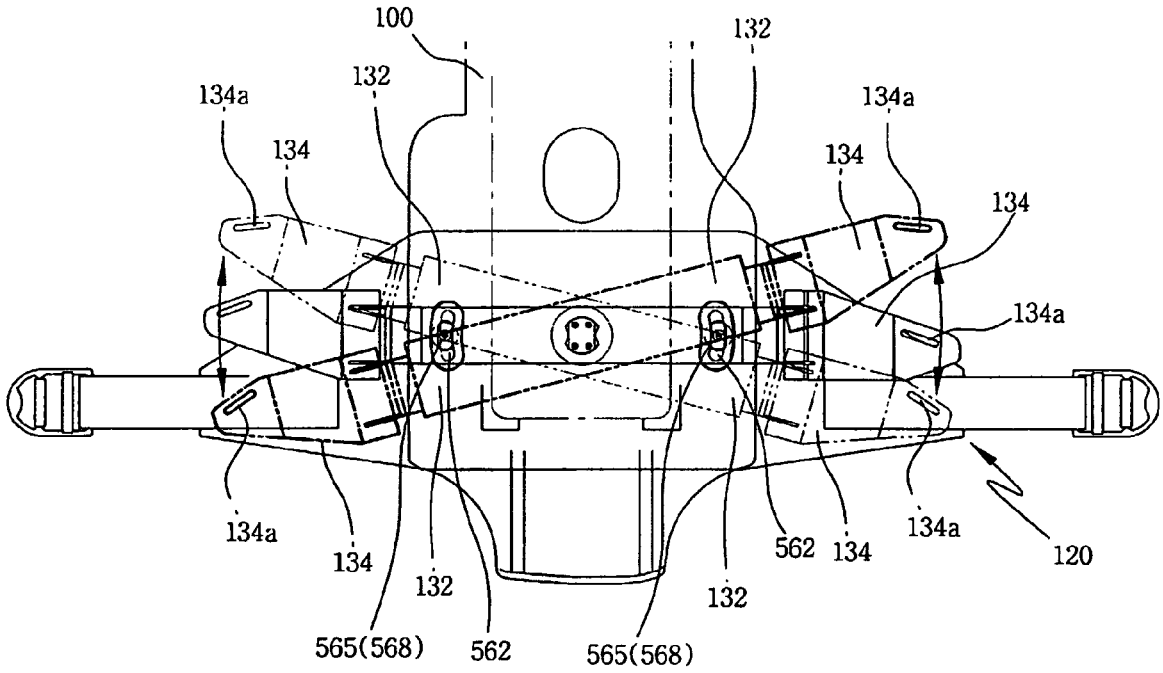
FIG. 19 is a view showing the state of the harness support of FIG. 11 in use.
Figure 20:
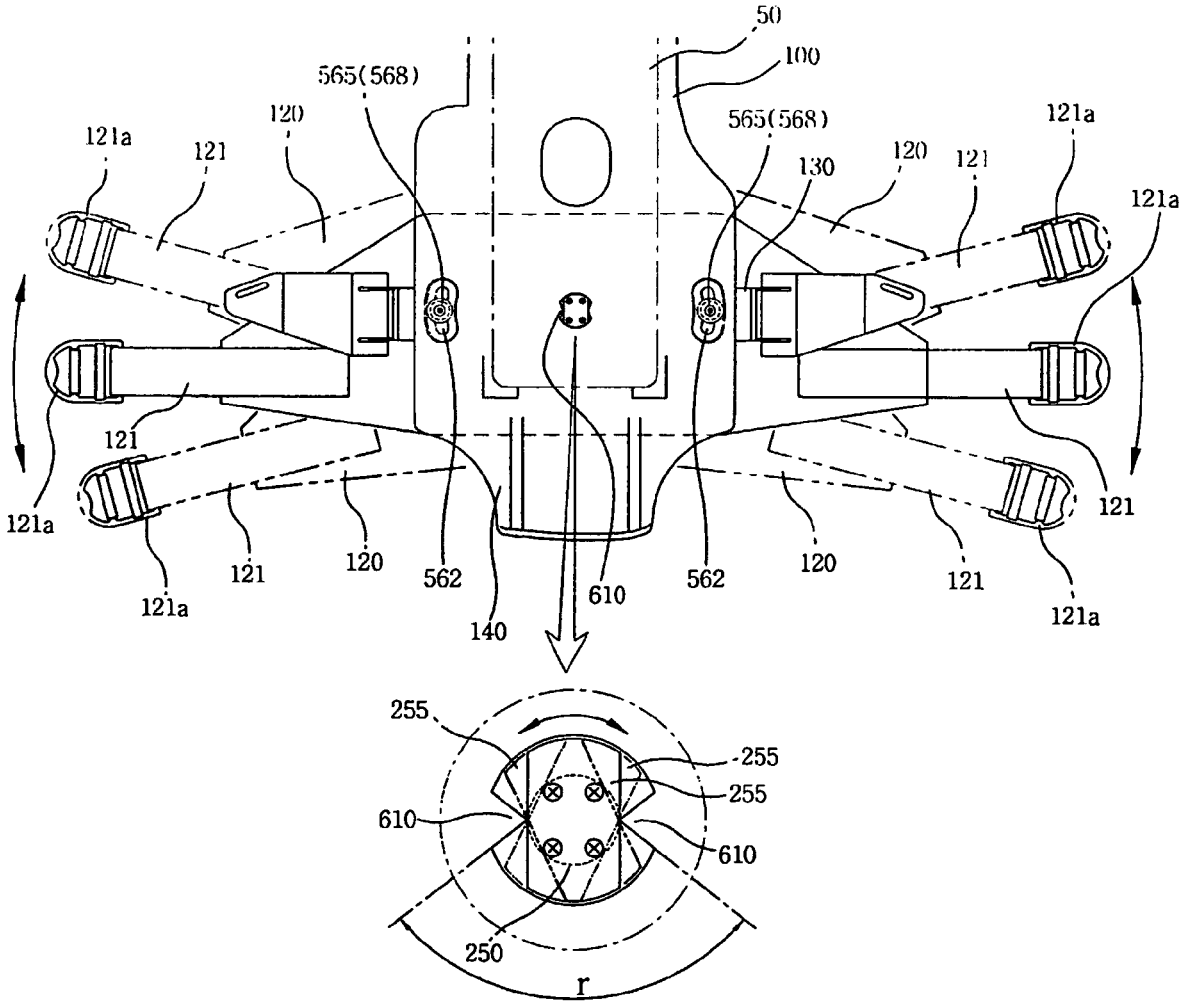
FIG. 20 is a view showing the state of the waist protector of FIG. 11 in a rotating motion.
Figure 21:
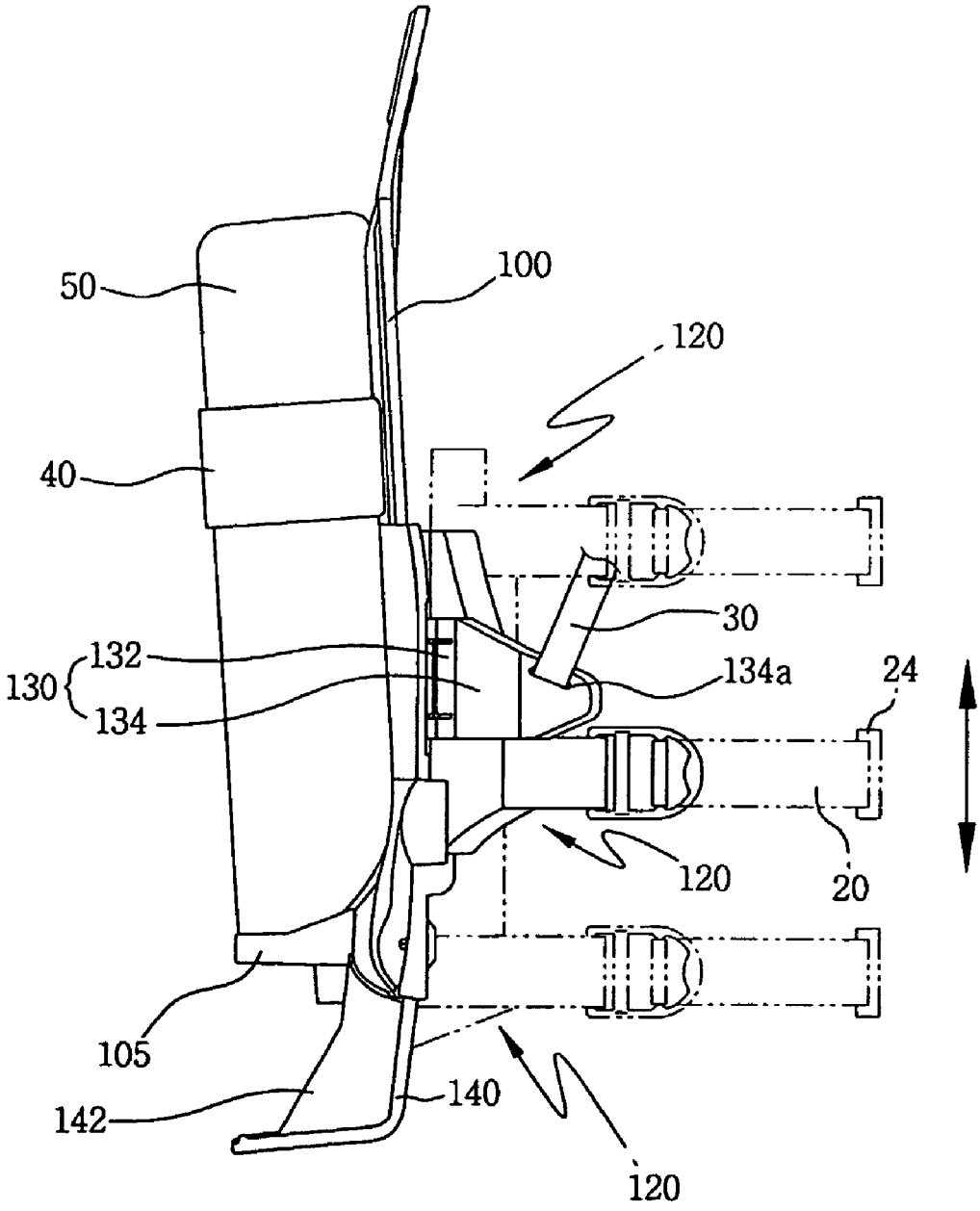
FIG. 21 is a view showing the state of the waist protector of FIG. 11 in a rising and falling motion.
Figure 22:
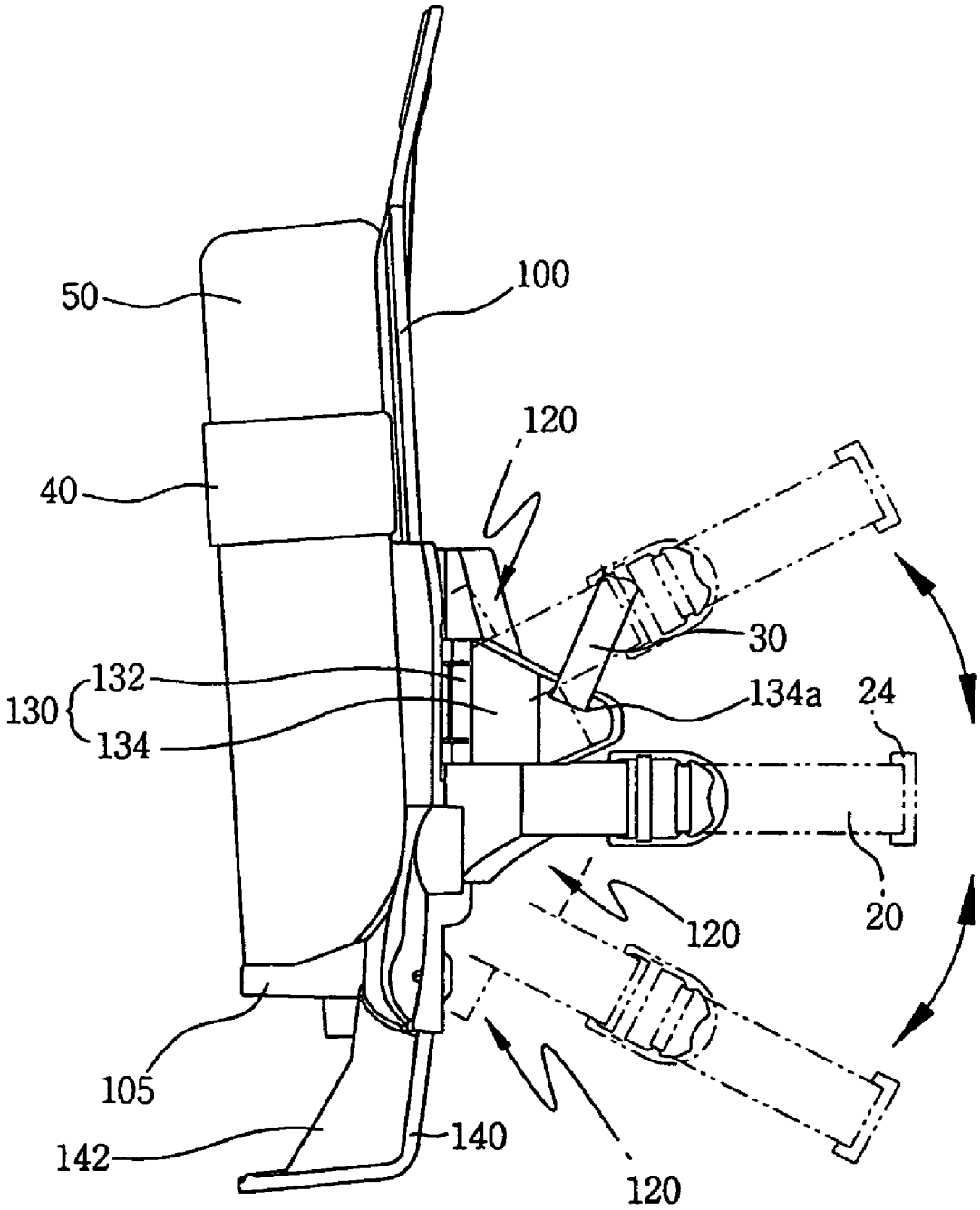
FIG. 22 is a view showing the state of the waist protector of FIG. 11 in a forward and backward moving motion.

Furthermore, FIG. 19 is a view showing the state of the harness support of FIG. 11 in use. FIG. 20 is a view showing the state of the waist protector of FIG. 11 in a rotating motion. FIG. 21 is a view showing the state of the waist protector of FIG. 11 in a rising and falling motion. FIG. 22 is a view showing the state of the waist protector of FIG. 11 in a forward and backward moving motion.

As shown in FIGS. 11 and 12, the backpack according to the second embodiment of the present invention comprises a backboard 100, with a cylinder fastening belt 40 and a support hook 105 provided on a middle portion and a lower portion of the backboard 100, respectively, and the upper ends of shoulder harnesses 30 mounted to an upper portion of the backboard 100.

Furthermore, both a harness support 130 and a waist protector 120 are rotatably mounted to the backboard 100 by a rotary unit having the same construction as the first embodiment. The harness support 130 comprises a longitudinal rectangular plate 132 to which the lower ends of the shoulder harnesses 30 and a waist belt 20 are coupled. In other words, both the harness support 130 and the waist protector 120 are rotatably mounted to the backboard 100 by a hinge shaft 250 of which one end is mounted to the waist protector 120. The other end of the hinge shaft 250 passes through both the rectangular plate 132 of the harness support 130 and the backboard 100 and is integrated with a hinge shaft cover 255.

In the backpack of the second embodiment, two harness locking holes 102 to hold the upper ends of the harnesses 30 are formed on the upper portion of the backboard 100 as shown in FIG. 11. Both sides of the upper edge of the upper portion of the backboard 100 protrude upwards as shown in the drawing, with the harness locking holes 102 formed on the upper protruding parts of the upper portion of the backboard 100. Thus, pressure applied from the upper parts of the harnesses 30 to the shoulders of a user back-mounting the backpack is more efficiently distributed to both sides of the backboard 100 in comparison with the backpack according to the first embodiment.

The backpack according to the second embodiment comprises a rotation guide means which guides the rotation of the harness support 130 and controls the rotating angle of the support 130; a rotating angle control means which controls the rotating angle of the waist protector 120; and a lift assembly which moves the waist protector 120 vertically on the backboard 100 while sliding the protector 120 on the backboard 100.

The rotation guide means, the rotating angle control means and the lift assembly will be described in detail herein below with reference to the accompanying drawings.

First, the rotation guide means comprises longitudinal guide holes 562 on both sides of each of the longitudinal rectangular plate 132 of the harness support 130 and the backboard 100 as shown in FIG. 10. Flanged rod-shaped protrusions pass through the longitudinal guide holes 562, with a plate-shaped or ring-shaped locking member mounted to an end of each flanged rod-shaped protrusion. Thus, the flanged rod-shaped protrusions move in the longitudinal guide holes 562 during rotation of the harness support 130.

In the present invention, the protrusions and the locking members may comprise ring nuts 565 and washer-shaped covers 568 having a size larger than the guide holes 562, respectively, as shown in the drawing. The ring nuts 565 are flanged at their rear ends. The flanges of the ring nuts 565 are closely placed on the rear surface of the longitudinal rectangular plate 132 of the harness support 130. The washer-shaped covers 568 may be mounted to the ends of the ring nuts 565 through welding or soldering. However, it is preferred to mount the washer-shaped covers 568 to the ends of the ring nuts 565 using locking screws 569 as shown in the drawing. In the above case, the locking screws 569 pass through the washer-shaped covers 568 and are tightened to inner threads formed on the inner surfaces of the ring nuts 565.

Alternatively, the protrusions and the locking members may comprise pin bolts 565' and nuts 568', respectively, as shown in the drawing. The pin bolts 565' are closely placed on the rear surface of the longitudinal rectangular plate 132 of the harness support 130, while the nuts 568' are tightened to outer threads formed around the ends of the pin bolts 565'.

As a further alternative, the protrusions and the locking members may comprise pins (not shown) having flanges at rear ends in the same manner as the ring nuts 568 and snap rings (not shown) mounted to the ends of the pins, respectively. In the above case, a fitting groove must be formed around a circumferential outer surface of the end of each pin to hold the snap ring on the pin.

When the rotation guide means comprises the pin bolts 565' and the nuts 568', or the flanged pins (not shown) and snap rings (not shown) as described above, the locking screws 569 which pass through the washer-shaped covers 568 may be eliminated, thus reducing the number of steps in the process of producing the backpacks and the manufacturing costs of the backpacks.

In the following description, the backpack according to the second embodiment will be described with the rotation guide means comprising the ring nuts 565 and the washer-shaped covers 568 mounted to the ring nuts 565 using the locking screws 569. Thus, the front ends of the ring nuts 565 are held on the harness support 130 by the washer-shaped covers 568, while the rear ends of the nuts 565 are held on the backboard 100 by the flanges.

Therefore, during rotation of the harness support 130 around the hinge shaft 250, the ring nuts 565 move along the longitudinal guide holes 562. In the above case, the length of the guide holes 562 determines the moving range of the ring nuts 565 in the guide holes 562.

As shown in FIGS. 13 and 14, the longitudinal guide holes 562 are designed to form arcs with the center of the hinge shaft 250, of which arc angles $\theta$ and $\alpha$ are preferably set to 3°~28° around the center of the hinge shaft 250.

Particularly, the arc angles $\theta$ of the longitudinal guide holes 562 formed on the backboard 100 are preferably set to 22°~28°, while the arc angles $\alpha$ of the longitudinal guide holes 562 formed on the harness support 130 are preferably set to 3°~13°.

In the second embodiment of the present invention, the arc angles $\theta$ and $\alpha$ of the longitudinal guide holes 562 formed on the backboard 100 and the harness support 130 are set to 22° and 4°, respectively. When setting the arc angles $\theta$ and $\alpha$ to the above-mentioned values, the ring nuts 565 can move along the guide holes 562 of the backboard 100 within a range allowed by the arc angle 22°, and further move along the guide holes 562 of the harness support 130 within another range allowed by the arc angle 4°. Thus, the ring nuts 565 can move within a range allowed by a total arc angle 26°.

The angular range of 26° at which the ring nuts 565 move is determined in consideration in that the above-mentioned angle is most suitable for allowing smooth motion of the user's shoulders.

As described above, the longitudinal guide holes 562 of the rotation guide means are formed on the ends of the longitudinal rectangular plate 132 of the harness support 130 and, furthermore, the ring nuts 565 are placed separately from the waist protector 120. Thus, the backpack according to the second embodiment is advantageous in that, even when the shoulder harnesses 30 are tensioned on the shoulders of the user, the ends of the longitudinal rectangular plate 132 of the harness support 130 are not twisted.

The design of the backpack capable of preventing the ends of the longitudinal rectangular plate 132 from twisting is as follows: First, the ring nuts 565 are separated from the waist protector 120, so that the ring nuts 565 do not restrict the longitudinal rectangular plate 132.

Second, because the rotation guide means, comprising the longitudinal guide holes 562 and the ring nuts 565, is provided on both ends of the plate 132, the flanges of the ring nuts 565 smoothly support the ends of the plate 132.

Furthermore, reinforcing plates 500 are preferably mounted to both ends of the longitudinal rectangular plate 132 of the harness support 130 as shown in FIG. 14. Thus, the reinforcing plates 500 enhance the strength of the guide holes 562 of the rectangular plate 132 as shown in the drawing.

The reinforcing plates 500 are attached to the ends of the longitudinal rectangular plate 132, so as to overlap the areas around the guide holes 562. Of course, a longitudinal hole corresponding to the longitudinal guide holes 562 must be formed on each of the reinforcing plates 500 to allow the ring nuts 565 to pass through the reinforcing plates 500.

When the reinforcing plates 500 are attached to the ends of the longitudinal rectangular plate 132 as described above, the plate 132 can reliably resist external force applied from the harnesses 30. Thus, the longitudinal rectangular plate 132 further effectively avoids twisting.

The rotating angle control means comprises a hinge shaft cover 255 which has a rectangular shape and is mounted to the end of the hinge shaft 250 to form an integrated structure so as to rotate along with the hinge shaft 250, as shown in FIGS. 12 and 13; and inclined protrusions 610 formed on the backboard 100 on opposite sides of the hinge shaft cover 255 to stop the cover 255 during rotation of the cover 255, thus causing the waist protector 120 to rotate within an angular range determined by the inclination angle γ of the protrusions 610. In other words, the inclination angle γ of the protrusions 610 is equal to both the rotating angle of the waist protector 120 and the rotating angle of the hinge shaft 250. The hinge inclination angle γ of the protrusions 610 is shown in FIG. 20.

As shown in the drawings, the inclined protrusions 610 are formed on opposite sides of a hinge shaft passing hole 250*a* provided on the backboard 100, and have a triangular shape, with the apexes of the triangular protrusions 610 coming into point contact with opposite sides of the hinge shaft cover 255.

Of course, the inclined protrusions 610 may be formed on upper and lower parts of the hinge shaft passing hole 250*a* differently from the structure shown in the drawings. In the above case, the rectangular hinge shaft cover 255 must be designed so that the horizontal axis thereof defines the longer axis differently from the structure shown in the drawings.

The hinge shaft cover 255 is designed to rotate at an angle of 25°~42°, preferably 30°, around the hinge shaft 250 by the inclination of the protrusions 610. To achieve the above-mentioned rotating angle of the cover 255, the inclination angle of the protrusions 610 must be specifically designed in consideration of the desired rotating angle of the cover 255.

Because both the hinge shaft cover 255 and the inclined protrusions 610 are designed as described above, the rotating angle of the hinge shaft 250 is limited to 30°. Thus, during rotation of the hinge shaft 250, the hinge shaft cover 255 rotates at 30°. When the hinge shaft cover 255 has rotated at 30°, the inclined surfaces of the protrusions 610 stop the opposite sides of the hinge shaft cover 255, thus stopping the rotation of the cover 255. Therefore, the hinge shaft 250 only rotates within an angular range of 30°.

The rotating angle of the waist protector 120 is determined by the rotating angle of the hinge shaft 250. In other words, the waist protector 120 rotates around the hinge shaft 250 at 30°. The 30° rotating angle of the waist protector 120 is determined in consideration of the motions of the user's waist. Because the waist protector 120 can rotate around the hinge shaft 250 at 30°, the user back-mounting the backpack of the present invention does not feel any discomfort while moving his/her body.

The lift assembly comprises a cap-shaped guide boss 710 that protrudes forwards to define a space therein, a lift guide 720, a guide protrusion 722, and a locking member 724 as shown in FIGS. 15 to 18. The lift assembly having the above-mentioned construction is placed between the hinge shaft 250 of the rotary unit and the waist protector 120 as shown in the drawings.

The construction of the lift assembly will be described in detail herein below with reference to FIG. 17. First, the guide boss 710 protrudes from the waist protector 120 to face the hinge shaft 250, with a longitudinal vertical slot 712 formed on the front surface of the boss 710. In the present invention, the guide boss 710 is preferably formed on a support panel 126 placed within a flame retardant cover 122 of the waist protector 120.

The guide boss 710 may be integrally formed with the support panel 26 during an injection molding process of producing the support panel 26 to form an integrated structure. Alternatively, the guide boss 710 may be formed separately from the support panel 26, prior to being mounted to the support panel 126 through bolting or riveting. The formation of the guide boss 710 is well known to those skilled in the art and further explanation is thus not deemed necessary. The guide boss 710 moves vertically along with the waist protector 120 during vertical movement of the waist protector 120.

The lift guide 720 has a size larger than the width of the vertical slot 712 formed on the guide boss 710, and is closely placed on the rear surface of the guide boss 710 as shown in the drawings.

The guide protrusion 722 extends forwards from the center of the lift guide 720 as shown in the drawings. The guide protrusion 722 passes through the vertical slot 712 of the guide boss 710, and is coupled to the hinge shaft 250 at an end thereof. Thus, the guide protrusion 722 engaging with the vertical slot 712 guides vertical movement of the guide boss 710 when both the waist protector 120 and the guide boss 710 move vertically.

In the present invention, the lift guide 720 may be replaced with a flange of the guide protrusion 722. In that case, the flange of the guide protrusion 722 is closely placed on the rear surface of the guide boss 710. The flange of the guide protrusion 722 may have a variety of shapes, such as a circular or rectangular shape.

In the present invention, the guide protrusion 722 of the lift guide 720 and the hinge shaft 250 are preferably coupled to each other through a spline coupling. To achieve the spline coupling, the rear end surface of the hinge shaft 250 is formed with a groove 722' as shown in FIG. 17, while the hinge shaft 250 is coupled to the groove 722' of the guide protrusion 722 through the spline coupling. Thus, the hinge shaft 250 is prevented from sliding on the end of the guide protrusion 722. In the above case, the groove 722' must have a shape corresponding to the end of the guide protrusion 722.

The locking member 724 may comprise a longitudinal locking screw as shown in the drawings. The locking member 724 sequentially passes through the lift guide 720 and the guide protrusion 722 prior to being threaded into the hinge shaft 250, thus integrating the hinge shaft 250 and the guide protrusion 722 into a single structure. The locking member 724 mounts the guide protrusion 722 to the rotary unit. The coupled state of the guide boss 710, the lift guide 720, and the locking member 724 is shown in detail in FIG. 16.

As shown in the drawing, the guide boss 710 preferably has a rounded shape R on its front surface. Thus, during vertical movement of the waist protector 120, the guide boss 710 moves vertically relative to the guide protrusion 722 of the lift guide 720 while forming a curved trace caused by the rounded shape R of the front surface. When the guide boss 710 is constructed to move vertically while forming the curved trace caused by the rounded shape R of the front surface as described above, the waist protector 120 can move smoothly. In the above state, the guide boss 710 during vertical movement is guided by the guide protrusion 722 that passes through the vertical slot 712.

The lift assembly may further comprise a tilting means which tilts the waist protector 120 during forward and backward movement of the waist protector 120.

The tilting means comprises the lift guide 720 which has slope surfaces to define a triangular cross-section as shown in FIGS. 16 to 18, and a guide ring member 740 which has a triangular cross-section corresponding to the lift guide 720 and is fitted over the guide protrusion 722 of the lift guide 720 to be closely placed on the rounded front surface of the guide boss 710. Thus, both the lift guide 720 and the guide ring member 740 execute a seesawing motion while supporting the guide boss 710 by the protruding parts thereof having the slope surfaces. The seesawing motion of both the lift guide 720 and the guide ring member 740 is shown in detail in FIG. 16.

In the present invention, the guide protrusion 722 of the lift guide 720 must be lengthened to provide sufficient length to allow the ring member 740 to be effectively fitted over the protrusion 722. That is, the guide protrusion 722 must be lengthened by the thickness of the ring member 740. If the lift assembly is constructed without the above-mentioned tilting means, the guide ring member 740 may be eliminated, thus reducing the length of the guide protrusion 722.

The lift assembly may further include an anti-friction member 760, in addition to the above-mentioned tilting means, as shown in FIGS. 16 to 18.

The anti-friction member 760 is placed between the guide boss 710 and the lift guide 720 to prevent direct contact of the guide boss 710 with the lift guide 720. To achieve the above-mentioned object, the anti-friction member 760 is preferably designed to have a ring-shaped appearance as shown in FIG. 17. In the embodiment, the anti-friction member 760 is fitted over the guide protrusion 722 at a position between the guide boss 710 and the lift guide 720.

Furthermore, the anti-friction member 760 is preferably shaped to have a zigzag cross-section as shown in the drawings, thus elastically supporting the lift guide 720 relative to the guide boss 710. In other words, the anti-friction member 760 may comprise a plate spring with ring-shaped ridges and grooves.

When the anti-friction member 760 is designed in the form of the plate spring with the ring-shaped ridges and grooves as described above, the anti-friction member 760, using its restoring force, elastically returns the lift guide 720 to its original position during the seesawing motion of the guide 720 while the waist protector 120 moves forwards and rearwards. The enlarged view of FIG. 16 shows the anti-friction member 760 of which the lower part is in a compressed state as the upper part of the lift guide 720 has moved downwards, while the remaining view shows the lift guide 720 returned to its original position by the restoring force of the anti-friction member 760.

In the meantime, as shown in FIG. 18, the longitudinal rectangular plate 132 of the harness support 130 and an anti-friction member 300 are sequentially fitted over the hinge shaft 250 that is mounted to the guide protrusion 722 of the lift guide 720 by the locking members 724. Furthermore, the hinge shaft 250 passes through the hinge shaft passing hole 250*a* of the backboard 100 and is coupled to the hinge shaft cover 255 by means of the locking screws 290.

The operation of both the lift assembly and the tilting means of the present invention will be easily understood from the following description in conjunction with FIG. 16 as well as FIG. 18.

The operation of both the lift assembly and the tilting means will be described herein below with reference to FIG. 16. As shown in the drawing, when the waist protector 120 rotates in response to a movement of the body of the user, the hinge shaft 250 rotates around its central axis along with the waist protector 120 (circumferential rotation).

When the waist protector 120 moves upwards and downwards, the guide boss 710 moves in the same direction under the guide of the guide protrusion 722 of the lift guide 720 that engages with the vertical slot 712 of the guide boss 710.

In the meantime, when the waist protector 120 moves forwards and backwards, both the lift guide 720 and the ring member 740 execute the seesawing motion to tilt the waist protector 120 forwards and backwards. In the above case, the anti-friction member 760 is compressed to generate elastic restoring force. Thus, when the tilted waist protector 120 is returned to its original position, the anti-friction member 120 elastically biases the lift guide 720 by the restoring force, thus returning the lift guide 720 it its original position.

When the user back-mounting the backpack according to the second embodiment moves his/her shoulders, the harness support 130 rotates around the hinge shaft 250 due to the tensioned shoulder harnesses 30 as shown in FIG. 19. In the above case, the rotating angle of the harness support 130 is limited by both the longitudinal guide holes 562 formed on both the longitudinal rectangular plate 132 and the backboard 100, and the ring nuts 565 that move along the guide holes 562.

In the meantime, when the user of the backpack bends his/her body to the left or right, the waist protector 120 rotates around the hinge shaft 250 as shown in FIG. 20. In the above case, the rotating angle $\gamma$ of the hinge shaft 250 is limited to 30° because of both the rectangular hinge shaft cover 255 mounted to the end of the hinge shaft 250 and the inclined protrusions 610 formed on the opposite sides of the hinge shaft passing hole 250*a* of the backboard 100. Of course, the waist protector 120 in the above state rotates at the same rotating angle as the angle $\gamma$ of the hinge shaft 250.

Furthermore, when the user of the backpack bends his/her body forwards, the waist protector 120 moves vertically while being tilted upwards or downwards as shown in FIGS. 21 and 22. During the vertical movement of the waist protector 120, the guide boss 710 moves in the same direction while being guided by the guide protrusion 722 of the lift guide 720. When the waist protector 120 is tilted upwards or downwards, both the lift guide 720 and the ring member 740 execute a seesawing motion while compressing or tensioning the anti-friction member 760. During the vertical movement with the upward and downward tilting motion of the waist protector 120, the anti-friction member 760 frees both the lift guide 720 and the guide boss 710 from friction.

The structures according to the first and second embodiments of the present invention may be adapted to conventional knapsacks in place of backpacks with specified functions. When adapting the present invention to the conventional knapsacks, the backboard 100 may be used as the back of a knapsack. It should be understood that the present invention is not limited to a backpack specifically used for back-mounting a compressed-air cylinder.

Although the preferred embodiments of the present invention have been disclosed for illustrative purposes, those skilled in the art will appreciate that various modifications, additions and substitutions are possible within the scope and spirit of the invention.

Thus, the elements, shapes and structures illustrated in the embodiments of the present invention may be modified, without departing from the scope and spirit of the invention as disclosed in the accompanying claims.

INDUSTRIAL APPLICABLITY

As described above, the present invention provides a backpack of which a waist belt and shoulder harnesses move separately from a backboard, thus preventing the center of gravity of a compressed-air cylinder fastened to the backboard from being undesirably shifted. Furthermore, because the waist belt and the harnesses separately move, the backpack allows a user back-mounting the backpack to easily move his/her body.

In addition, when ring nuts are installed in the backpack separately from a waist protector, longitudinal guides holes are formed on the ends of a longitudinal rectangular plate of a harness support, thus preventing the ends of the longitudinal rectangular plate from twisting. As the ends of the longitudinal rectangular plate are spaced apart from the waist protector to steadily maintain the tensioned state of the harnesses, the user back-mounts the backpack comfortably.

Furthermore, as the waist protector of the backpack rotates around a hinge shaft and moves upwards, downwards, forwards and backwards by a guide boss, a guide protrusion of a lift guide, and a ring member, the user back-mounts the backpack more comfortably and moves his/her body more easily while back-mounting the backpack.

Another advantage of the present invention resides in that the protective plate provided at the lower end of the backboard is formed as a plate shape capable of preventing the protective plate from catching on protruding objects. Furthermore, the protective plate may be formed as a single structure integrated with the backboard during the process of producing the backboard, thus reducing the time required to produce the backpack. Because a battering casing to hold batteries therein is provided on the front surface of the backboard, the user can easily, quickly and conveniently exchange the batteries for new ones.

The invention claimed is:

1. A backpack for back-mounting a compressed-air cylinder (50), fastened to the backpack by a cylinder fastening belt (40), when a user wears harnesses (30) and a waist belt (20), comprising:

a backboard (100) which holds, on an upper portion thereof, one ends of the harnesses (30) and holds, at both sides of a middle portion thereof, the cylinder fastening belt (40), and comprises a pair of support hooks (105) that protrude from a lower portion of the backboard (100) while being spaced apart from each other to support thereon the compressed-air cylinder (50);

a harness support (130) which holds, at opposite arms thereof, the other ends of the harnesses (30) and is coupled to a lower portion of a back surface of the backboard (100) so as to rotate upwards and downwards around a center thereof, with the opposite arms of the harness support (130) longitudinally extending horizontally in opposite directions;

a waist protector (120) having a plate shape coupled to the backboard (100) at a position in the back of the harness support (130) so that both ends of the waist protector rotate upwards and downwards around a center of the waist protector, with ends of the waist belt (20) coupled to the ends of the waist protector, the waist protector thus covering and protecting the back of the user's waist; and a rotary unit for rotatably supporting both the harness support (130) and the waist protector (120) on the backboard (100).

2. The backpack according to claim 1, wherein the harness support (130) comprises:

a longitudinal rectangular plate (132) extending in a horizontal direction and coupled to the backboard (100) so as to rotate upwards and downwards around a center thereof; and a harness coupling bracket (134) coupled to each end of the longitudinal rectangular plate (132) so as to bend, with a harness coupling hole (134*a*) provided on an end of the harness coupling bracket to hold the other end of each of the harnesses (30).

3. The backpack according to claim 2, wherein the harness coupling hole (134*a*) of the harness coupling bracket (134) is formed as a longitudinal hole extending in a horizontal direction, wherein the harness coupling hole (134*a*) is inclined downwards in a direction from an inside to an outside part of the harness coupling bracket (134) at an inclination angle (β) of 22°~55° relative to a horizontal axis so that the other end of each of the harnesses (30) is coupled in an inclined position to the harness coupling bracket (134).

4. The backpack according to claim 1, wherein the rotary unit comprises:

a hinge shaft (250) protruding from the center of the waist protector (120) and sequentially passing through the center of the harness support (130) and a center of the lower portion of the backboard (100), thus serving as a rotating shaft for both the waist protector (120) and the harness support (130);

a hinge shaft cover (255) mounted to the hinge shaft (250) at a position in front of the backboard (100), so as to rotatably couple the hinge shaft (250) to the backboard (100); and a locking member (290) which locks the hinge shaft cover (255) to the hinge shaft (250).

5. The backpack according to claim 4, wherein the rotary unit further comprises:

rotation guide means for guiding rotation of both the waist protector (120) and the harness support (130), and controlling rotating angles of the waist protector and the harness support, the rotation guide means comprising:

guide protrusions (260) protruding from opposite sides of the waist protector (120); and first and second longitudinal guide holes (260*a* and 260*b*) having an arc-shaped appearance and receiving the guide protrusions (260) therein, and formed on opposite sides of the lower portion of the backboard (100) and opposite sides of the harness support (130), respectively, wherein, after the guide protrusions (260) sequentially pass through the first and second guide holes (260*a* and 260*b*), protrusion covers (265) are mounted to the guide protrusions (260) using a plurality of locking screws (290*a*) so that the guide protrusions (260) move upwards and downwards along the first and second guide holes (260*a* and 260*b*), thus controlling rotating angles of both the waist protector (120) and the harness support (130).

6. The backpack according to claim 5, wherein the first guide holes (260*a*) formed on the backboard (100) and the second guide holes (260*b*) formed on the harness support (130) are shaped to have arc angles (θ) set to 22°~28° and (α) set to 7°~13°, respectively, around the center of the hinge shaft (250) passing through the backboard (100) so that the arc angles (θ and α) determine lengths of the first and second guide holes (260*a* and 260*b*).

7. The backpack according to claim 4, wherein the rotary unit further comprises:

rotation guide means for guiding rotation of the harness support (130), the rotation guide means comprising:

longitudinal guide holes (562) formed on both sides of each of the longitudinal rectangular plate (132) of the harness support (130) and the backboard (100); and flanged rod-shaped protrusions (565, 565') passing through the longitudinal guide holes (562), with a plate-shaped or ring-shaped locking member (568, 568') mounted to an end of each of the flanged rod-shaped protrusions (565, 565'), so that the flanged rod-shaped protrusions (565, 565') move in the longitudinal guide holes (562) during rotation of the harness support (130).

8. The backpack according to claim 4 or 7, wherein the rotary unit further comprises:

rotating angle control means for controlling the rotating angle of the waist protector (120), the rotating control means comprising:

the hinge shaft cover (255) having a rectangular shape and mounted to the end of the hinge shaft (250); and inclined protrusions (610) formed on the backboard (100) on opposite sides of the hinge shaft cover (255) to stop the hinge shaft cover (255) during rotation of the hinge shaft cover (255), thus causing the waist protector (120) to rotate within an angular range determined by an inclination angle (γ) of the protrusions (610).

9. The backpack according to claim 1, further comprising:

a lift assembly to move the waist protector (120) vertically on the backboard (100) while sliding the protector on the backboard (100).

10. The backpack according to claim 9, wherein the lift assembly comprises:

a guide boss (710) protruding from the waist protector (120) to face the rotary unit, thus moving vertically along with the waist protector (120) during vertical movement of the waist protector, with a vertical slot (712) formed on a front surface of the guide boss;

a lift guide (720) closely placed on a rear surface of the guide boss (710);

a guide protrusion (722) extending from the lift guide (720) to pass through the vertical slot (712) of the guide boss (710), and coupled to the rotary unit at an end thereof, thus guiding vertical movement of the guide boss (710); and a locking member for mounting the guide protrusion (722) of the lift guide (720) to the rotary unit.

11. The backpack according to claim 10, wherein the guide boss (710) has a rounded shape (R) on the front surface thereof, thus causing the guide boss (710) to move vertically while forming a curved trace caused by the rounded shape (R).

12. The backpack according to claim 10, wherein the lift assembly further comprises:

tilting means for tilting the waist protector (120) during forward and backward movement of the waist protector (120).

13. The backpack according to claim 12, wherein the tilting means comprises:

the lift guide (720) having slope surfaces to define a triangular cross-section; and a guide ring member (740) having a triangular cross-section corresponding to the lift guide (720) and fitted over the guide protrusion (722) of the lift guide (720) to be closely placed on the front surface of the guide boss (710), so that both the lift guide (720) and the guide ring member (740) execute a seesawing motion while supporting the guide boss (710) by protruding parts thereof having the slope surfaces.

14. The backpack according to claim 10, further comprising:

an anti-friction member (760) having a ring shape and fitted over the guide protrusion (722) of the lift guide (720) at a position between the guide boss (710) and the lift guide (720), thus preventing direct contact of the guide boss (710) with the lift guide (720).

15. The backpack according to claim 14, wherein the anti-friction member (760) is shaped to have a zigzag cross-section, thus elastically supporting the lift guide (720) relative to the guide boss (710).

16. The backpack according to claim 1, further comprising:

flashing lamps (104) provided on opposite sides of the lower portion of the backboard (100) to make flicker; and a protective plate (140) which extends downwards from a lower end of the backboard (100) while maintaining a predetermined width and bending at a lower part thereof to protrude forwards from the backboard (100), so as to protect an end of the compressed-air cylinder (50) fastened to the backboard (100) from external impact.

17. The backpack according to claim 16, wherein the protective plate (140) further comprises:

a pair of reinforcing ribs (142) extending along opposite side edges of the forward bending part of the protective plate (140) to increase strength of the protective plate (140) in a vertical direction; and a battery casing (106) provided between the pair of reinforcing ribs (142) to be protected at opposite sides thereof by the reinforcing ribs (142) and holding a battery therein to supply electricity to the flashing lamps (104) of the backboard (100).

* * * * *